US006318133B1

(12) United States Patent
Koshiga et al.

(10) Patent No.: US 6,318,133 B1
(45) Date of Patent: Nov. 20, 2001

(54) WASHING MACHINE

(75) Inventors: Kenji Koshiga; Shinichi Nakajima, both of Osaka; Junichi Morinaka, Shiga; Shinichi Matsuda; Toshihiko Ura, both of Osaka; Kenichi Akasaka, Hyogo; Norimasa Kondo, Osaka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/677,596

(22) Filed: Oct. 3, 2000

Related U.S. Application Data

(62) Division of application No. 09/207,204, filed on Dec. 8, 1998, now Pat. No. 6,148,646.

(30) Foreign Application Priority Data

| | | |
|---|---|---|
| Jun. 6, 1997 | (JP) | 9-148873 |
| Jun. 6, 1997 | (JP) | 9-148895 |
| Apr. 10, 1998 | (JP) | 10-99102 |
| Apr. 22, 1998 | (JP) | 10-111942 |
| May 28, 1998 | (JP) | 10-147131 |

(51) Int. Cl.[7] ..... D06F 37/40
(52) U.S. Cl. ..... 68/23.7
(58) Field of Search ..... 68/23.6, 23.7

(56) References Cited

U.S. PATENT DOCUMENTS

| | | | |
|---|---|---|---|
| 2,527,238 | 10/1950 | Woodson | 68/23.7 X |
| 2,947,159 | 8/1960 | Imai et al. | 68/23.7 |
| 4,232,536 | 11/1980 | Koseki et al. . | |
| 5,586,455 | 12/1996 | Imai et al. | 68/23.7 X |
| 5,619,871 | 4/1997 | Forbes et al. | 68/23.7 |
| 5,778,703 | 7/1998 | Imai et al. . | |
| 5,887,458 | 3/1999 | Bae | 68/23.7 |

FOREIGN PATENT DOCUMENTS

| | | | |
|---|---|---|---|
| 2 285 063 | 6/1995 | (GB) . | |
| 2 314 092 | 12/1997 | (GB) . | |
| 9-010474 | 1/1997 | (JP) . | |
| 179091 | 9/1985 | (JP) | 68/23.7 |

*Primary Examiner*—Philip R. Coe
(74) *Attorney, Agent, or Firm*—Wenderoth, Lind & Ponack, L.L.P.

(57) ABSTRACT

A washing machine includes a washing shaft for rotating agitating blades disposed in a dewatering tank, and the washing shaft is disposed coaxially on a hollow dewatering shaft for rotating the dewatering tank. The washing shaft is connected to the output side of a reduction mechanism, and a washing side input shaft is connected to the input side of the reduction mechanism to rotate the washing shaft by decelerating the rotation of a drive motor. A rotor of the drive motor is coupled to the lower part of the washing side input shaft. Therefore, the rotating torque of the agitating blades can be increased without increasing the torque of the drive motor. In addition, if the laundry collides against the agitating blades, the eccentricity to the washing side input shaft is suppressed, thereby the increase of the washing capacity can be handled without increasing the size of the drive motor.

7 Claims, 29 Drawing Sheets

(a)

(b)

WASHING MACHINE

This application is a divisional application of Ser. No. 09/207,204, filed Dec. 8, 1998, and now U.S. Pat. No. 6,148,646.

FIELD OF THE INVENTION

The present invention relates to a washing machine for washing and rinsing by agitating blades which rotate at low speed, and dewatering by high speed rotation of a dewatering tank.

BACKGROUND OF THE INVENTION

Conventionally, a washing machine was composed as shown in FIG. 31 and FIG. 32. Its constitution is described below.

As shown in FIG. 31, in an outer casing 1, an outer tank 3 is supported by a suspension 2, and a dewatering tank 4 serving also as a washing tank (hereinafter called dewatering tank 4) is provided in the outer tank 3. The dewatering tank 4 is opened at the top, so that the laundry can be loaded from the top. Agitating blades 5 are provided in the bottom, and multiple holes are opened in the side wall.

The dewatering tank 4 is fixed on a dewatering shaft 7 supported by a bearing 6 provided in the bottom of the outer tank 3. The agitating blades 5 are fixed on a washing shaft 9 supported by a bearing 8 inside of the dewatering shaft 7. This washing shaft 9 is connected to a reduction mechanism 10, and a pulley 12 is fitted to a washing side input shaft 11. In the mounting part of the pulley 12 of the washing side input shaft 11, four sides are cut off, and the mounting hole of the pulley 12 has a fitting shape, and the torque of the pulley 12 is transmitted. The pulley 12 is connected to a drive motor 14 through a belt 13. The washing side input shaft 11 has a clutch mechanism 15 for transmitting the rotation of the drive motor 14 by changing over to the washing shaft 9 or dewatering shaft 7.

The clutch mechanism 15 comprises, as shown in FIG. 32, a clutch input boss 15*d* having a hole in a shape to be fitted into the cut portion of the four sides provided in the washing side input shaft 11, a clutch spring 15*b*, a control pawl 15*e* formed by bending the end of the clutch spring 15*b*, a release sleeve 15*c* having a notch for fitting the control pawl 15*e* formed by bending the end of the clutch spring 15*b*, clutch drive means 15*a* to be engaged with a stopper 15*f* of the release sleeve 15*c*, and a clutch output boss 15*g* of the dewatering shaft 7 on which the clutch spring 15*b* is wound.

In this constitution, in the washing and rinsing stroke, when the clutch drive means 15*a* of the clutch mechanism 15 is engaged with the stopper 15*f* of the release sleeve 15*c*, and the control pawl 15*e* formed by bending the end of the clutch spring 15*b* is fixed, the clutch spring 15*b* cannot be wound around the clutch input boss 15*d*, and if the clutch input boss 15*d* rotates, rotation cannot be transmitted to the clutch output boss 15*g* of the dewatering shaft 7. Rotation of the drive motor 14 is transmitted only to the agitating blades 5 through the washing shaft 9, and mechanical force is given to the laundry. Thus, washing and rising of the laundry contained in the dewatering tank 4 are progressed.

In the dewatering stroke, when the clutch drive means 15*a* of the clutch mechanism 15 is disengaged from the stopper 15*f* of the release sleeve 15*c*, and the control pawl 15*e* formed by bending the end of the clutch spring 15*b* is set free, the clutch spring 15*b* is wound around the clutch input boss 15*d*. Accordingly, when the clutch input boss 15*d* rotates, rotation is transmitted to the clutch output boss 15*g* of the dewatering shaft 7. Rotation of the drive motor 14 is transmitted only to the dewatering tank 4 through the dewatering shaft 7, and the entire dewatering tank 4 is put into rotation. As the dewatering tank 4 rotates, the water in the laundry after washing and rinsing is wrung out by centrifugal force into the outer tank 3 through multiple holes opened in the side wall of the dewatering tank 4. Thus, the laundry is dewatered automatically.

In such conventional washing machine, the drive motor 14 is transmitting power to the reduction mechanism 10 through the belt 13. Accordingly, if one attempts to apply a larger mechanical force to the laundry in order to increase the washing capacity or to enhance the cleaning power, transmission torque is defined by the upper limit by belt slip, belt elongation, belt breakage, or tension changes of the belt 13 due to time-course changes, and transmission torque corresponding to large capacity cannot be obtained.

Moreover, since heavy objects, that is, the drive motor 14 and the reduction mechanism 10, are disposed side by side beneath the outer tank 3, the position of the center of gravity of the dewatering tank 4 and outer tank 3 suspended in the outer casing 1 is deviated from the center of rotation (dewatering shaft 7) of the dewatering tank 4. Therefore, in dewatering rotation of the dewatering tank 4, the balance is likely to be broken, and vibration due to rotation becomes larger.

To solve such problems, a washing machine constituted as shown in FIG. 33 has been proposed.

As shown in FIG. 33, an outer tank 16 is suspended by a plurality of suspensions 18 in an outer casing 17, and inside of the outer tank 16. Moreover, there is a dewatering tank 20 serving also as washing tank (hereinafter called dewatering tank 20) which is fixed to the upper end side of a dewatering shaft 19 and is rotated by the dewatering shaft 19. At the side of the dewatering tank 20, a plurality of water passing holes 21 are formed, and a liquid balancer 22 is disposed at the upper opening, so that the laundry may be loaded through the upper opening.

A bearing 21 supports the dewatering shaft 19, and is provided in the bottom of the outer tank 16. A washing shaft 24 is disposed inside of the hollow dewatering shaft 19, and is disposed to be coaxial with the dewatering shaft 19. At the upper end of the washing shaft 24, agitating blades 25 are provided rotatably in the inner bottom of the dewatering tank 20, and a rotor 27 of a drive motor 26 is connected to the lower end. The drive motor 26 comprises the rotor 27 and a stator 28 disposed oppositely to a magnet provided on the outer circumference of this rotor 27, and the rotor 27 is rotated by the rotary magnetic field of the stator 28. Between the lower end of the dewatering shaft 19 and the rotor 27, a clutch mechanism 30 is provided through a coupling 29, and by changing over the clutch mechanism 30, rotation of the rotor 27 is transmitted or not transmitted to the dewatering shaft 19.

In this constitution, in the washing and rinsing stroke, the clutch mechanism 30 is changed over, and the dewatering shaft 19 and rotor 27 are cut off. Therefore, the rotation of the rotor 27 of the drive motor 26 is transmitted only to the agitating blades 25 through the washing shaft 24, and a mechanical force is given to the laundry. Thus, washing and rinsing of the laundry contained in the dewatering tank 20 are progressed.

In the dewatering stroke, the water in the dewatering tank 20 is discharged, the clutch mechanism 30 is changed over, and the dewatering shaft 19 and rotor 27 are coupled, thereby rotating the washing shaft 24, dewatering shaft 19 and dewatering tank 20 coupled to the rotor 27 of the drive motor 26. As the dewatering tank 20 rotates, the water in the laundry after washing and rinsing is wrung out into the water tank 16 from multiple water passing holes 21 provided in the side of the dewatering tank 20 by centrifugal force. Thus, the laundry is dewatered.

In the washing machine of such constitution, however, in order to effectively suppress any imbalance in the dewatering stroke, the center of rotation of the dewatering shaft 19 and the washing shaft 24 were disposed coaxially with the rotary shaft of the drive motor 26 by using a coupling 30. The position of center of gravity of the dewatering tank 20 and outer tank 16 was also matched nearly with the position of center of gravity of the drive motor 26. It therefore required alignment of the coupling 30, the assembling performance was poor, and the washing machine was higher by the portion of the height of the coupling 30, which added to the cost.

SUMMARY OF THE INVENTION

The invention is to solve the problems of the prior arts, and it is an object thereof to present a washing machine capable of increasing the rotating torque of the agitating blades without increasing the torque of the drive motor, and capable of coping with an increase of the washing capacity, while avoiding an increase in the size of the drive motor, by suppressing eccentricity to the washing side input shaft if the laundry collides against the agitating glades.

In the invention, to achieve the above objects, a washing shaft for rotating the agitating blades disposed in a dewatering tank is disposed coaxially on a hollow dewatering shaft for rotating the dewatering tank, the washing shaft is connected to the output side of a reduction mechanism, a washing side input shaft is connected to the input side of the reduction mechanism to rotate the washing shaft by decelerating the rotation of the drive motor, and a rotor of the drive motor is coupled to the lower part of the washing side input shaft. In this constitution, therefore, since the agitating blades are rotated by reducing the rotating speed of the drive motor by the reduction mechanism, the rotating torque of the agitating blades can be increased without increasing the torque of the drive motor. If the laundry collides against the agitating blades, the eccentricity of the washing shaft is absorbed by the reduction mechanism, and eccentricity of the reduction mechanism to the washing side input shaft can be suppressed. In addition, the eccentricity of the rotor coupled to this input shaft is suppressed, the gap between the rotor and stator is decreased, a size increase of the drive motor is avoided, and a washing machine capable of coping with an increase of washing capacity is presented. Moreover, since the rotor is coupled directly to the washing side input shaft, the bearing of the washing side input shaft can be used commonly without particularly installing a bearing for the drive motor.

Preferably, the reduction mechanism and drive motor are disposed coaxially, and the clutch mechanism for transmitting or not transmitting the rotation of the drive motor to the dewatering shaft is composed of a torque transmitting unit for transmitting rotation of the drive motor to the dewatering shaft and a drive unit for contacting with or departing from the torque transmitting unit. In this embodiment, part of the torque transmitting unit is formed in the rotor of the drive motor. Therefore, the position of the center of gravity the of dewatering tank and the outer tank and the center of rotation of the dewatering tank can be matched, generation of imbalance in dewatering can be suppressed, and the belt is not necessary so therefore problems caused by the belt are eliminated. Moreover, since part of the torque transmitting unit of the clutch mechanism is formed in the rotor of the drive motor, the number of parts is decreased and the assembling performance is enhanced, the clutch mechanism is reduced in thickness and size. Therefore, an increase of capacity in the lower part of the main body of the washing machine can be suppressed.

More preferably, the drive motor is composed of a rotor, a stator, and a stator housing, and the stator housing is held in the case incorporating the dewatering shaft. In this constitution, the assembling performance is enhanced by eliminating matching of axial centers of the drive motor, dewatering shaft and washing shaft, or by a gap adjustment of the rotor and stator. Moreover, the gap between the rotor and stator is reduced, and an increase in the size of the drive motor is avoided. Hence, it is possible to cope with an increase of washing capacity without adding to the cost.

Further preferably, in the constitution in which the reduction mechanism and drive motor are disposed coaxially, the clutch mechanism is disposed inside of the stator housing for composing the drive motor, and the clutch driving means for driving the clutch mechanism is driven from outside of the stator housing, the number of parts is curtailed, and generation of imbalance in dewatering is suppressed. If water overflows from the outer tank due to some cause, water is prevented from entering inside of the drive motor, and if the clutch lever area is touched by hand by mistake, fingers are not caught into the drive motor, so that the safety is enhanced.

BRIEF DESCRIPTION OF THE DRAWINGS

FIG. 3(*b*) is an essential sectional view of the drive unit in dewatering stroke of the same washing machine;

DETAILED DESCRIPTION OF THE INVENTION

A first embodiment of the invention is described below while referring to FIG. 1 to FIG. 3.

Figure 1:
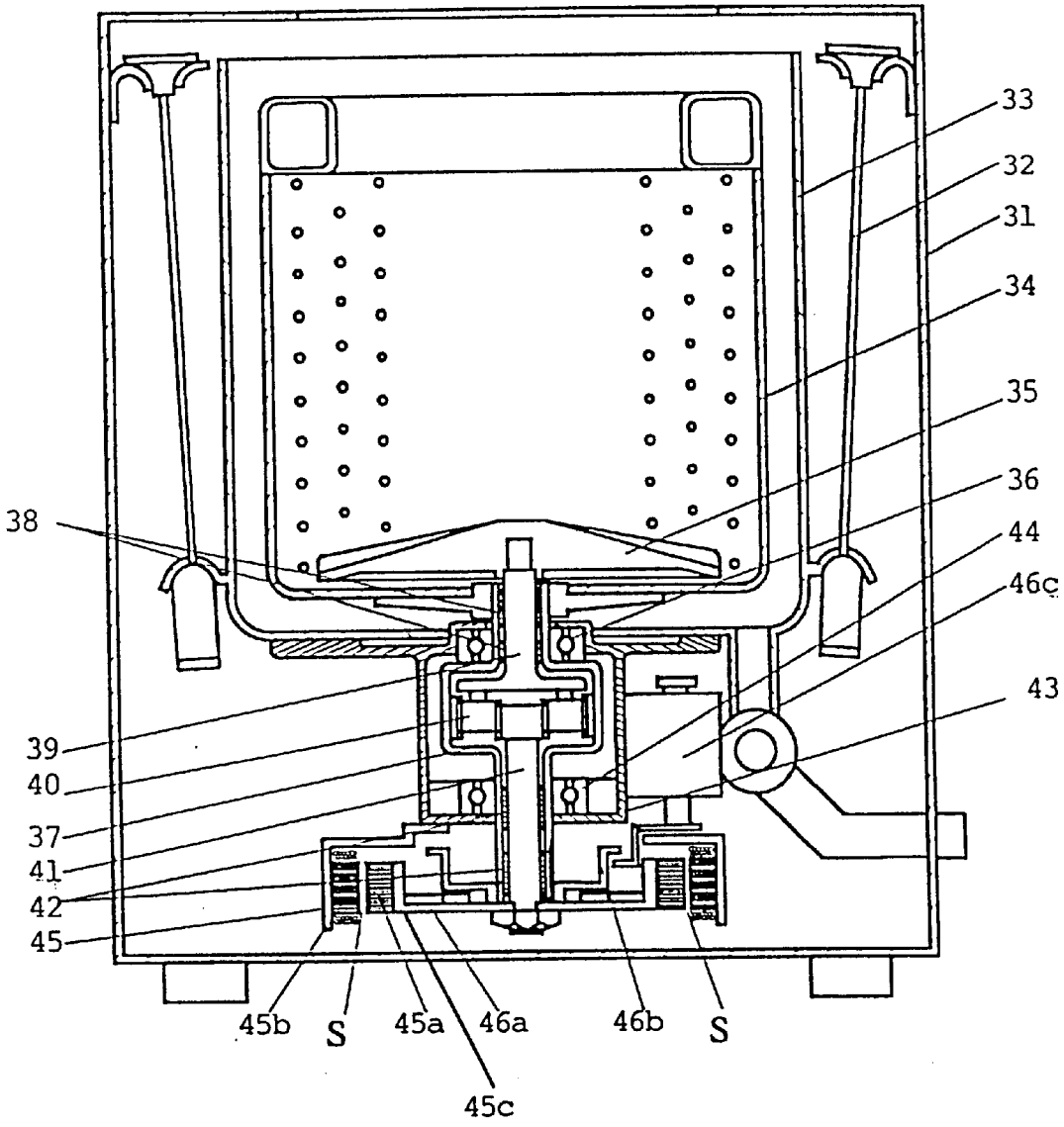
FIG. 1 is a sectional view of a washing machine in a first embodiment of the invention.

As shown in FIG. 1, in an outer casing 31, an outer tank 33 is suspended by a suspension 32, and vibration of dewatering is absorbed by the suspension 32. In the outer tank 33, a dewatering tank 34 serving also as a washing tank (hereinafter called dewatering tank 34) is rotatably disposed. In the inner bottom of the dewatering tank 34, agitating blades 35 for agitating the laundry are rotatably disposed. A hollow dewatering shaft 37 is supported by a dewatering bearing 36 provided in the center of the bottom of the outer tank 33. The upper end side of this dewatering shaft 37 is fixed in the bottom of the dewatering tank 34, and the dewatering tank 34 is rotated. A washing shaft 39 rotates the agitating blades 35 by fixing its upper end side to the agitating blades 35. This washing shaft 39 is disposed coaxially in the hollow part of the dewatering shaft 37, and is supported by a washing bearing 38 provided in the hollow part of the dewatering shaft 37.

A reduction mechanism 40 is incorporated in the dewatering shaft 37, and is designed to reduce the rotating speed by a gear group. In order to prevent abnormal rotation due to imbalance of the dewatering tank 34 in dewatering operation, preferably, the reduction mechanism is composed of a planet gear having plural gears arranged in a symmetrical profile. At the output side of this reduction mechanism 40, the washing shaft 39 is connected, and a washing side input shaft 41 is connected to the input side. The washing side input shaft 41 is supported by an input bearing 42 disposed in the lower side hollow part of the dewatering shaft 37. The dewatering shaft 37 incorporating the reduction mechanism 40 is incorporated in the case 43, and the lower part of the dewatering shaft 37 is supported by a bearing 44 provided in the lower part of the case 43. This case 43 is fixed to the bottom side of the outer tank 33.

A drive motor 45 is provided for rotating the dewatering shaft 37 and washing side input shaft 41, and comprises a disk-shaped rotor 45*a* having a magnet mounting part 45*c* extending in the height direction on its outer circumference, and a stator 45*b* disposed at the outer circumferential side of the magnet of the rotor 45*a* so as to be opposite to the magnet adhered to the outer circumference of the magnet mounting part 45*a,* for applying a rotary magnetic field to the rotor 45*a*. A gap S is provided between the stator 45*b* and rotor 45*a*. This gap S is set in consideration of fluctuation of parts so that the outer circumference of the rotor 45*a* rotated by the rotary magnetic field of the stator 45*b* (that is, the magnet) may not contact the stator 45*b*. The gap is also defined in consideration of the eccentric amount of the rotor 45*a* by the force received during rotation of the output shaft rotated by the drive motor 45, that is, rotation of the washing shaft 39 and dewatering shaft 37. The rotor 45*a* of the drive motor 45 is coupled to the lower part of the washing side input shaft 41, and the reduction mechanism 40 and drive motor 45 are disposed coaxially.

A clutch mechanism 46 is provided for transmitting or not transmitting the rotation of the drive motor 45 to the dewatering shaft 37, and it is partly coupled to the rotor 45*a* of the drive motor 45. That is, the clutch mechanism 46 comprises a torque transmitting unit for transmitting the torque of the rotor 45*a* of the drive motor 45, and a drive unit for contacting or departing from the torque transmitting unit. This torque transmitting unit is composed of a fixed clutch 46*a* formed in part of the rotor 45*a* coupled to the lower part of the washing side input shaft 41 of the reduction mechanism 40, and a movable clutch 46*b* contacting or departing from the fixed clutch 46*a*. The moveable clutch rotates together with the dewatering shaft 37 by a drive unit 46*c* composed of a solenoid and others.

Figure 2:
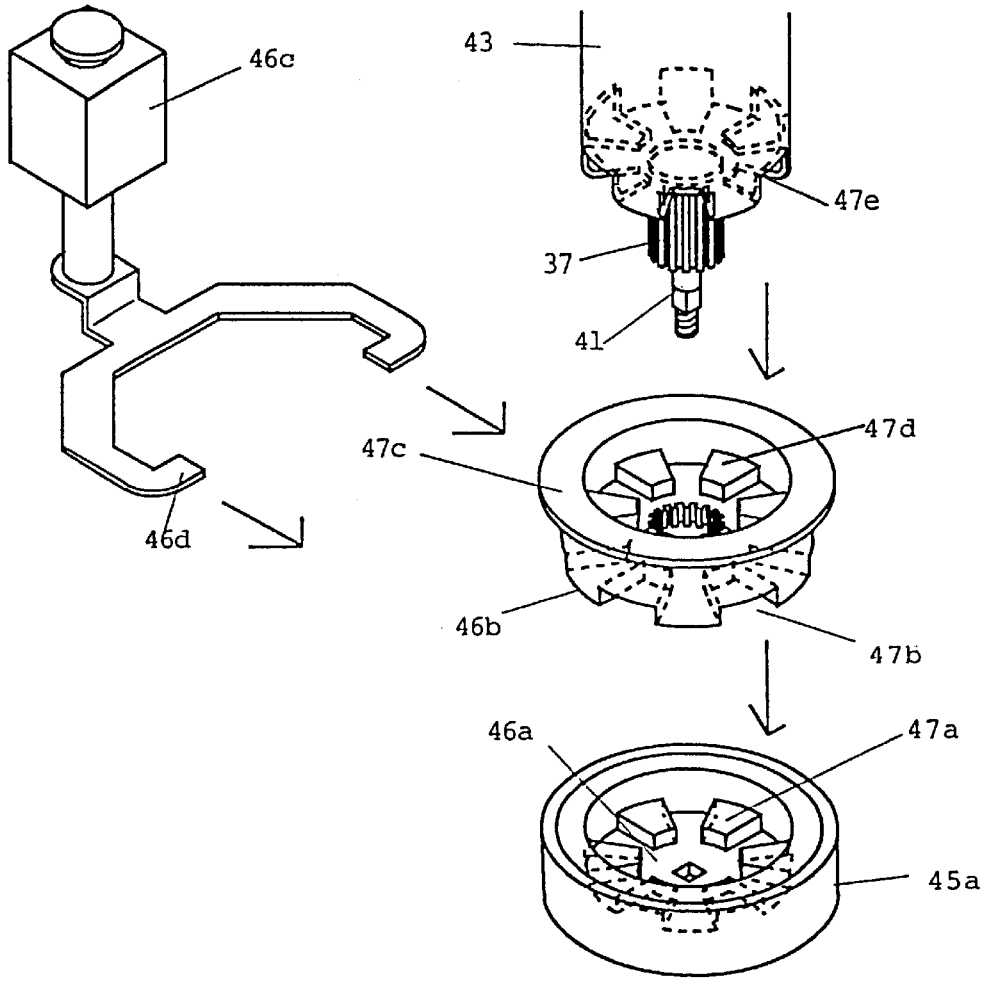
FIG. 2 is a perspective exploded view showing the constitution of a drive unit of the same washing machine.

As shown in FIG. 2, the fixed clutch 46*a* is formed as a part excluding the magnet of the rotor 45*a,* and its shape is a cylindrical shape with a bottom. A square through-hole is provided in the bottom for coupling the fixed clutch 46*a* with the lower end side of the washing side input shaft 41. On the upper side of the bottom, a bump 47*a* radially extending from the through-hole is formed. The movable clutch 46*b* has a cylindrical shape with a bottom so as to be inserted inward through the upper opening of the fixed clutch 46*a,* and a recess 47*b* is formed in its lower bottom so as to be engaged with the bump 47*a* of the fixed clutch 46*a*. A flange 47*c* is provided at the side of the movable clutch 46*b,* and the lower side of the flange 47*c* is designed to contact a lever 46*d* moved up and down by the solenoid 46*c*. Therefore, when the lever 46*d* is moved up and down by the solenoid 46*c,* the movable clutch 46*b* moves up and down in accordance with the motion of the level 46*d,* so as to contact with or depart from the fixed clutch 46*a*.

In the movable clutch 46*b,* a through-hole is formed in the center, and it is inserted into the lower side of the dewatering shaft 37. In the lower part of the dewatering shaft 37, a plurality of vertical grooves extending in the vertical direction are provided, and a plurality of bumps to be engaged with the vertical grooves of the dewatering shaft 37 are provided at the inner circumferential side of the through-hole of the movable clutch 46*b*. The movable clutch 46*b* is movable in the vertical direction along the vertical grooves of the dewatering shaft 37, while the bumps of the movable clutch 46*b* are engaged with the vertical grooves of the dewatering shaft 37. Therefore, while contacting the fixed clutch 46*a,* rotation of the movable clutch 46*b* can be transmitted to the dewatering shaft 37.

The movable clutch 46*b,* as shown in FIG. 1, is provided in the dewatering shaft 37 extending downward (to the clutch mechanism side) together with the outer casing of the reduction gear 40. At the downward side of the dewatering shaft 37, as shown in FIG. 2, a plurality of grooves extending in the vertical direction are provided, while the movable clutch 46*b* has a through-hole for passing the dewatering shaft 37, and a plurality of bumps to be engaged with the grooves of the dewatering shaft 37 are formed in this through-hole. Therefore, the movable clutch 46*b* can move up and down along the grooves in the dewatering shaft 37, and the torque of the movable clutch 46*b* is transmitted to the dewatering shaft side.

In the inner bottom of the movable clutch 46*b,* a plurality of bumps 47*d* extending radially from the through-hole of the dewatering shaft 37 are formed. On the other hand, in the bottom of the case 43 for accommodating the reduction mechanism 40, a notch 47*e* for fixing the bump 47*d* of the movable clutch 46*b* is formed. When the movable clutch 46*b* moves upward, the bump 47*d* is engaged with the notch 47*e,* and the rotation of the movable clutch 46*b* is arrested.

This embodiment relates to an inner rotor type in which the rotor 45*a* of the drive motor 45 is formed inside of the stator 45*b,* but it may be also formed in an outer rotor type in which the rotor 45*a* is formed outside of the stator 45*b,* or the stator 45*b* and rotor 45*a* may be opposite to each other in the vertical direction.

In such a constitution, the operation is described below. First, in a washing and rinsing stroke, power is supplied to the solenoid 46*c*. By the generated magnetic force, as shown in FIG. 3(*a*), the movable clutch 46*b* is moved to the side of the case 43 incorporating the reduction mechanism 40 (i.e., upward) and the engagement of the bump 47*a* of the fixed clutch 46*a* and the recess 47*b* of the movable clutch 46*b* is cleared. Since the engagement is cleared, rotation of the rotor 45*a* of the drive motor 45 is not transmitted to the dewatering shaft 37, but is transmitted only to the agitating blades 35 through the washing side input shaft 41, reduction mechanism 40, and washing shaft 39, and mechanical force is applied to the laundry so that agitating operation is carried out. Thus, washing and rinsing of the laundry contained in the dewatering tank 34 are progressed.

After the washing and rinsing stroke, the dewatering stroke begins. In the dewatering stroke, the water in the dewatering tank 34 is discharged, and power supply to the solenoid 46*c* is stopped at the same time. At this time, the movable clutch 46*b* descends along the vertical grooves of the dewatering shaft 37 by its own weight as shown in FIG. 3(*b*), and the bump 47*a* of the fixed clutch 46*a* and the recess 47*b* of the movable clutch 46*b* are engaged with each other. Therefore, due to the engagement of the bump 47*a* of the fixed clutch 46*a* and the recess 47*b* of the movable clutch 46*b,* the dewatering shaft 37 and rotor 45*a* are coupled with each other, and rotation of the rotor 45*a* of the drive motor 45 is transmitted to the dewatering shaft 37. Thus, the agitating blades 35 and the entire dewatering tank 34 rotate together. Due to the centrifugal force generated by rotation of the dewatering tank 34, the water in the laundry after rinsing is wrung out into the outer tank 33 from multiple holes formed in the side of the dewatering tank 34. Thus, the laundry is dewatered automatically.

In this way, the laundry charged in the dewatering tank 34 finishes the full strokes of washing, rinsing and dewatering.

In the washing and rinsing stroke, for example, when the rotation of the rotor 45*a* of the drive motor 45 and the washing side input shaft 41 is reduced to ⅙ by the reduction mechanism 40 and is transmitted to the washing shaft 39 and agitating blades 35 (ignoring the transmission efficiency), the torque is about six times larger than before reduction. Thus, in the structure of coupling the washing shaft 39 and washing side input shaft 41 through the reduction mechanism 40, if the torque of the drive motor 45 is small, the torque for rotating the agitating blades 35 can be increased, and an increase of washing capacity and enhancement of cleaning performance can be realized without increasing the torque of the drive motor 45.

Incidentally, the laundry collides against the agitating blades 35 and the washing shaft 39 receives an eccentric force. However, since the washing shaft 39 and washing side input shaft 41 are coupled through the reduction gear 40, this force is absorbed in the gap between gears of the reduction mechanism 40, and action of eccentric force on the washing side input shaft 41 is suppressed, so that eccentricity of the rotor 45*a* of the drive motor 45 coupled to the lower part of the washing side input shaft 41 can be prevented. Therefore, the gap S between the rotor 45*a* and stator 45*b* is not required to be larger than necessary, and no increase in th external size of the drive motor 45 is necessary. Still more, when the gap S between the rotor 45*a* and stator 45*b* is smaller, the torque for rotating the rotor 45*a* can be effectively enhanced.

Moreover, when assembling the drive motor 45, first the rotor 45*a* is fixed in the lower part of the washing side input shaft 41, then the annular stator 45*b* is inserted so as to be positioned at the outer circumferential side of this rotor 45*a,* and this stator 45*b* is fixed in the lower part of the case 43. Therefore, depending on the mounting position of the stator 45*b* or fluctuations of parts, the gap S between the rotor 45*a* and stator 45*b* may not be uniform along the whole circumference, and large gaps and small gaps occur. If the gap S is not uniform by assembling, the eccentric amount of the rotor 45*a* can be suppressed, and contact between the rotor 45*a* and stator 45*b* during rotation can be prevented.

Although the laundry collides against the agitating blades 35 and the washing shaft 39 receives an eccentric force, since the washing shaft 39 is supported by the washing bearing 38, this force is first received by the washing bearing 38, and then lessened by the reduction mechanism 40. Thus, eccentricity of the rotor 45*a* of the drive motor 45 is further suppressed.

Similarly, clothes collide against the dewatering tank 34, and the dewatering shaft 37 receives an eccentric force. However, rotation of the drive motor 45 is not transmitted to the dewatering shaft 37 in the washing and rinsing stroke by means of the clutch mechanism, so eccentricity of the dewatering shaft 37 is not transmitted to the drive motor 45. As a result, eccentricity of the rotor 45*a* of the drive motor 45 is further suppressed.

In addition, since the lower part of the washing side input shaft 41 and the clutch mechanism are directly coupled to the rotor 45*a* of the drive motor 45, the bearing for supporting the rotary shaft of the rotor 45*a* is not necessary, and alignment of the input bearing 42 of the washing side input shaft 41 coupled to the rotor 45*a* in its lower part and the bearing 39 of the dewatering shaft 37 is also not necessary.

Besides, the washing side input shaft 41 of the reduction mechanism 40 and the rotor 45*a* of the drive motor 45 are directly coupled. That is, since the reduction mechanism 40 and drive motor 45 are positioned coaxially, the position of the center of gravity of the dewatering tank 34, outer tank 33, the reduction mechanism 40 provided beneath the outer tank 33 and drive motor 45, and the center of rotation of the dewatering tank 34 can be matched approximately, and generation of imbalance during dewatering can be suppressed. In the structure of this embodiment, since the outer tank 33 is supported by the suspension 32, unless the heavy objects such as the reduction mechanism 40 and drive motor 45 are positioned coaxially, the center of gravity is deviated, and the dewatering tank 34 cannot be rotated smoothly. However, the dewatering tank 34 can be rotated smoothly in the embodiment. Further, since the reduction mechanism 40 and dewatering shaft 37 are rotated directly by the drive motor 45, the conventional belt is not needed, and problems of belt slip and durability do not exist.

In the dewatering stroke, it is possible that the dewatering shaft 37 may receive an eccentric force. However, the dewatering shaft 37 is supported by the dewatering bearing 36 and bearing 44, so this force is received by the dewatering bearing 36 and bearing 44. Therefore, eccentricity of the rotor 45*a* of the drive motor 45 can be further suppressed.

Since the torque transmitting unit composed of the fixed clutch 46*a* and movable clutch 46*b* is located between the rotor 45*a* of the drive motor 45 and the lower part of the dewatering shaft 37, the structure for transmitting and not transmitting the rotation of the rotor 45*a* of the drive motor 45 to the dewatering shaft 37 can be realized easily.

Moreover, part of the torque transmitting unit of the clutch mechanism 46 (i.e., the fixed clutch 46*a*) is formed on the rotor 45*a* of the drive motor 45. Thus, the number of parts is curtailed, the assembling performance is enhanced, and the clutch mechanism 46 is reduced in thickness and size, so a large volume is not needed beneath the outer casing 31. In particular, in this embodiment, the rotor 45*a* has a tubular form with a bottom, and the bump 47*a* for transmitting the torque of the clutch mechanism 46 is provided in its inner space. Therefore, the torque transmitting unit of the clutch mechanism 46 can be reduced in thickness, and an increase of volume beneath the outer casing 31 can be further suppressed.

The torque transmitting unit of the clutch 46 is composed of the fixed clutch 46*a* formed in the rotor 45*a,* and the movable clutch 46*b* contacting or departing from the fixed clutch 46*a* by the drive unit of the clutch mechanism 46. The movable clutch 46*b* is driven by the drive unit of the clutch mechanism 46 to contact the fixed clutch 46*a* when dewatering, and depart therefrom when washing. Therefore, when dewatering, due to the drive unit of the clutch mechanism 46, the movable clutch 46*b* contacts the fixed clutch 46*a,* and the washing shaft 39 and dewatering shaft 37 rotate together, so that dewatering is conducted. When washing, the movable clutch 46*b* departs from the fixed clutch 46*a,* and the dewatering shaft 37 does not rotate, while the washing shaft 39 is decelerated by the reduction mechanism 40, and the torque is enhanced and the agitating blades 35 are rotated to wash and rinse. Thus, in washing and rinsing, and in dewatering, the movable clutch 46*b* is moved to change over transmission to the dewatering shaft 37, while it is not necessary to move the fixed clutch 46*a* provided in the rotor 45*a,* so that complicated structure for moving the rotor 45*a* freely is not required.

Transmission of torque between the fixed clutch 46*a* and movable clutch 46*b* composing the torque transmitting unit of the clutch mechanism 46 is realized by the bump 47*a* and recess 47*b* formed on the outer circumferential side from the center of the through-hole. Therefore, if the torque for rotating the dewatering shaft 37 provided in the through-hole is increased, the recess 47*b* and bump 47*a* are not damaged. That is, when rotating the dewatering shaft 37 positioned in the through-hole from the position remote from the through-hole (the position of the recess 47*b* and bump 47*a*), the torque applied to the recess 47*b* and bump 47*a* can be suppressed by the force of moment, so that their damage can be prevented. Or, when rotating the dewatering shaft 37 by a large torque, as mentioned above, it is possible to suppress the torque applied to the bump 47*a* of the fixed clutch 46*a* and the recess 47*b* of the movable clutch 46*b* formed to be engaged therewith. Therefore, for increasing the strength of the fixed clutch 46*a* and movable clutch 46*b,* increase of size can be prevented, and it also contributes to reduction of thickness of the clutch mechanism 46.

Figure 3:
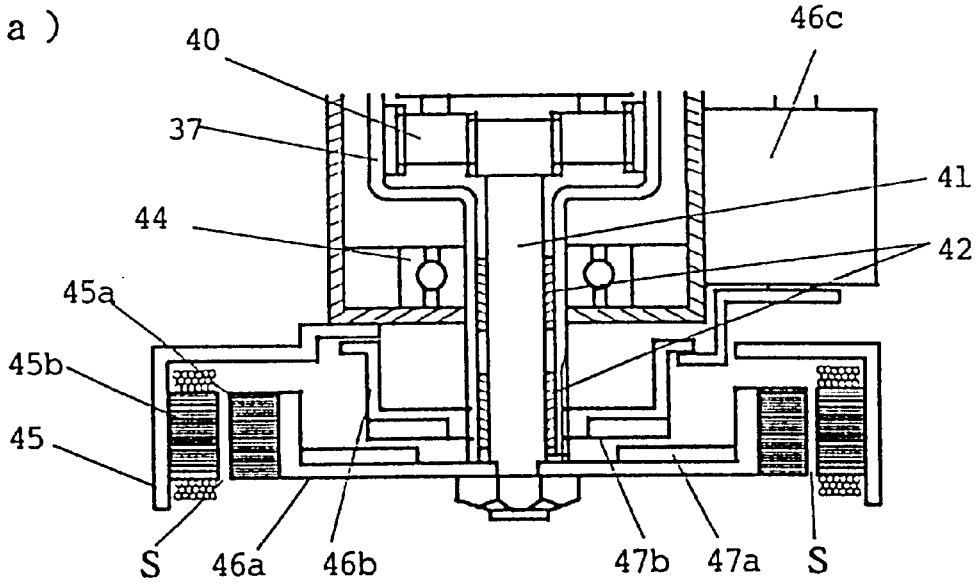
FIG. 3(*a*) is an essential sectional view of the drive unit in washing and rinsing stroke of the same washing machine.
Figure 3:
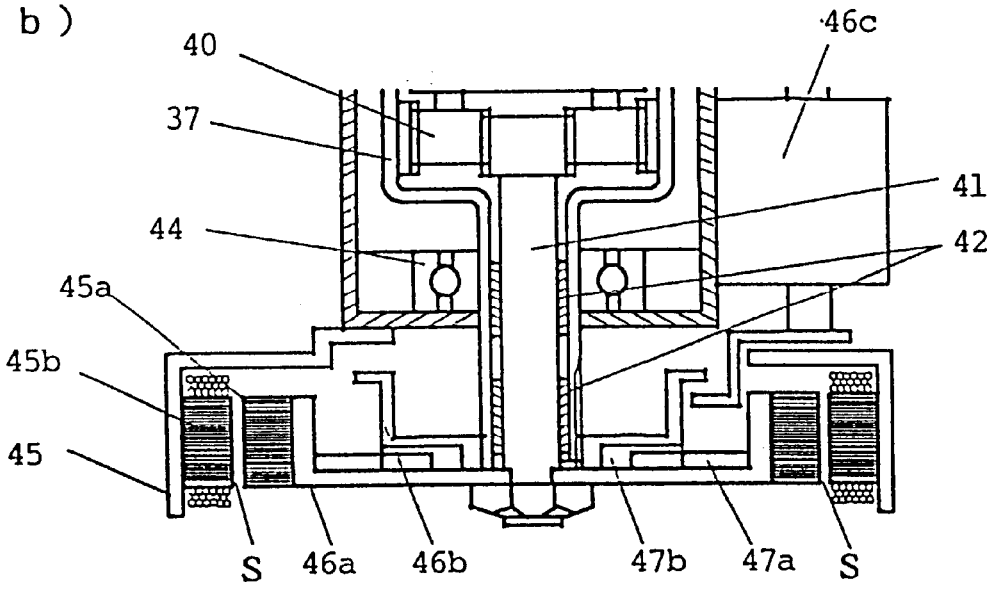

In this embodiment, as shown in FIG. 3(*a*), when washing, the movable clutch 46*b* is moved by the solenoid 46*c* in the thrust direction of the dewatering shaft 37 (i.e., it is moved upward to clear engagement with the bump 47*a* of the fixed clutch 46*a*), while a bump 47*d* of the movable clutch 46*b* is engaged with a notch 47*e* in the lower part of the case 43, so that rotation of the movable clutch 46*b* is blocked. Since the case 43 is fixed beneath the outer tank 33, this case 43 itself does not rotate.

Therefore, by rotating the washing shaft 39 by inverting the direction when washing, the agitating blades 35 are rotated in both directions to agitate the laundry, and when agitating the laundry, the dewatering tank 34 receives this agitating force to rotate together. However, since the movable clutch 46*b* is stopped by the notch 47*e* of the case 43, rotation of the dewatering shaft 37 fitted into the through-hole of the movable clutch 47*b* is also blocked, and the rotation of the dewatering tank 34 coupled to the dewatering shaft 37 is blocked, too.

In this way, by preventing simultaneous rotation of the dewatering tank 34 in washing and rinsing, decline of cleaning performance is prevented. Moreover, when the movable clutch 46*b* is designed to also have a function for preventing simultaneous rotation of the dewatering tank 34, the simultaneous rotation preventive mechanism of the dewatering tank 34 can be eliminated, and the assembling performance is enhanced. Moreover, since the simultaneous rotation preventive mechanism of the dewatering tank 34 is provided by making use of the upper side of the movable clutch 46*b,* there is no hindrance to reduction of thickness of the torque transmitting unit of the clutch mechanism 46.

In this embodiment, the rotor 45*a* and the fixed clutch 46*a* of the torque transmitting unit are formed integrally, but they may be also formed as independent members.

Figure 4:
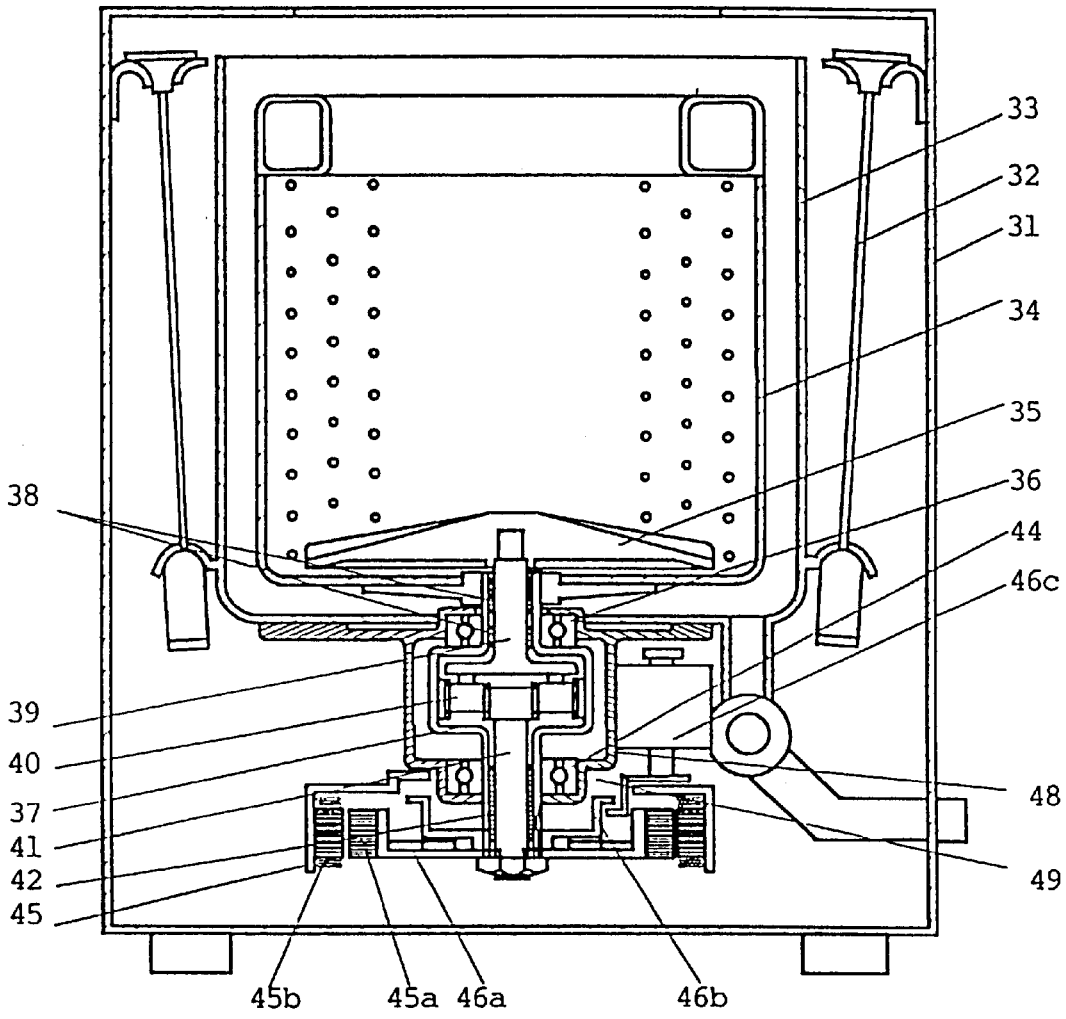
FIG. 4 is a sectional view of a washing machine in a second embodiment of the invention.

A second embodiment of the invention is described below while referring to FIG. 4. In FIG. 4, the same components as in the first embodiment are identified with the same reference numerals, and detailed description is omitted.

As shown in FIG. 4, a case 48 is formed in a tubular shape, and incorporates a dewatering shaft 37, and a bearing 44 for supporting the lower part of the dewatering shaft 37 is provided in a lower inner side. The lower outer circumference of the case 48 is curved to the axial central side, and a dent 49 is formed therein. The mounting part of a drive motor 45 is formed in this dent 49.

In this constitution, the drive motor 45 can be installed closely to the case 48. Therefore, the length of the washing side input shaft 41 for connecting the rotor 45*a* of the drive motor 45 and the reduction mechanism 40 can be shortened, and the eccentric amount of the rotor 45*a* can be decreased. In addition, the gap between the rotor 45*a* and stator 45*b* may be set smaller, so that the drive motor 45 is further reduced in size and enhanced in performance.

Since the movable clutch 46*b* is a tubular form with a bottom, when the movable clutch 46*b* moves upward, it covers the lower part of the case 48 having the dent 49, and this dent 49 also serves as a clearance for the movable clutch 46*b.* Therefore, in spite of the clutch mechanism, the length of the washing side input shaft 41 can be shortened, and the eccentric amount of the rotor 45*a* can be decreased.

Figure 5:
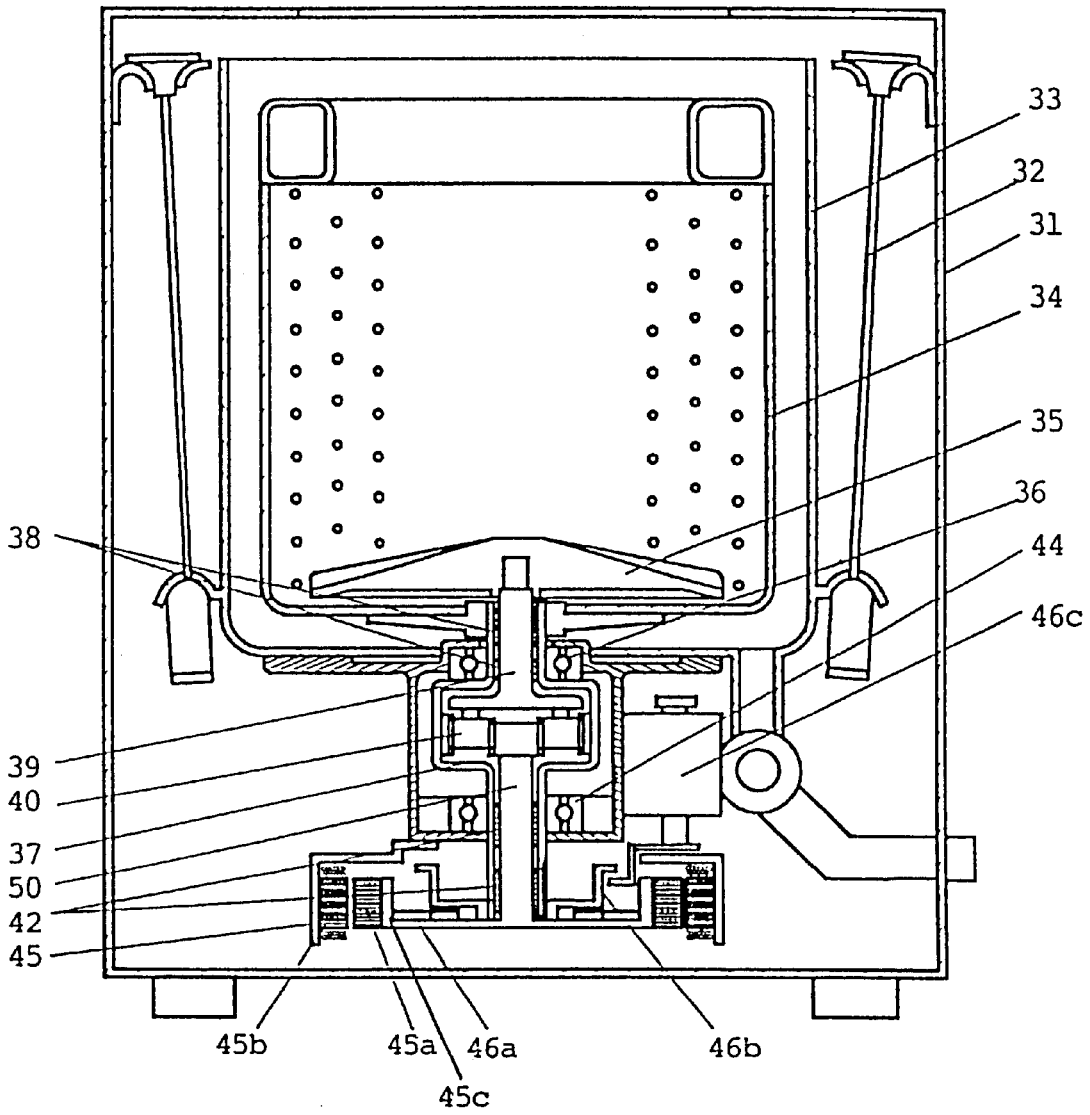
FIG. 5 is a sectional view of a washing machine in a third embodiment of the invention.

A third embodiment of the invention is described below while referring to FIG. 5. In FIG. 5, the same components as in the first embodiment are identified with the same reference numerals, and a detailed description is omitted.

As shown in FIG. 5, a washing side input shaft 50 is formed integrally with the rotor 45*a* of the drive motor 45. Except for this integral structure, it has the same function as the washing side input shaft 41 explained in the first embodiment.

In this constitution, since the rotor 45*a* of the drive motor 45 and the washing side input shaft 50 are formed integrally, the coupling strength of the rotor 45*a* and the washing side input shaft 50 is obtained if the rotor 45*a* is thin. Hence, the rotor 45*a* is reduced in weight, and the rotation starting characteristic is enhanced.

By the portion of reduction of thickness of the rotor 45*a,* the length of the washing side input shaft 38 can be shortened and the rotor 45*a* may be formed closely to the washing side input shaft 50. Therefore, the eccentric amount of the rotor 45*a* can be decreased.

Figure 6:
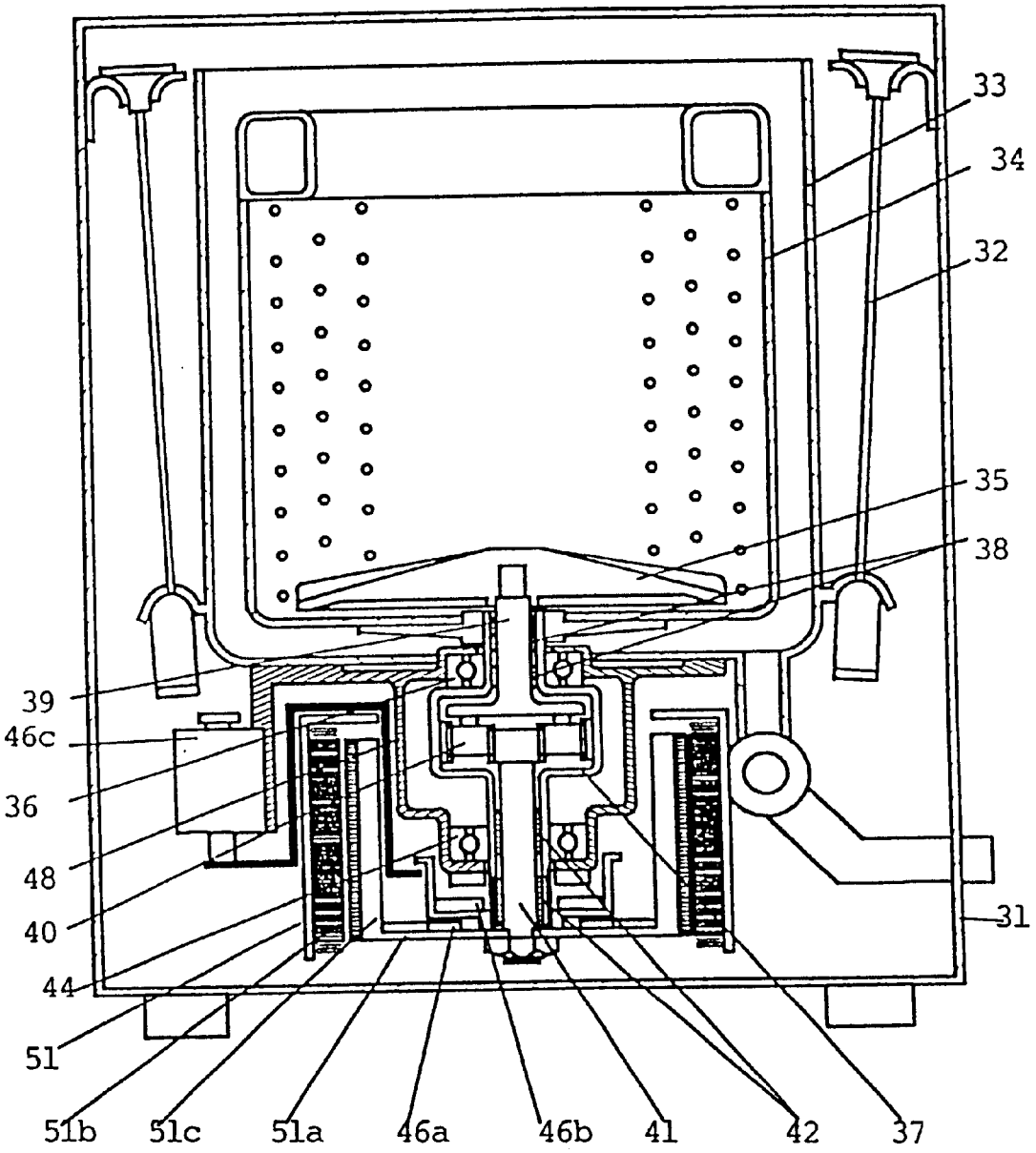
FIG. 6 is a sectional view of a washing machine in a fourth embodiment of the invention.

A fourth embodiment of the invention is described below while referring to FIG. 6. In FIG. 6, the same components as in the first embodiment are identified with the same reference numerals, and a detailed description is omitted.

As shown in FIG. 6, a drive motor 51 is composed of a rotor 51*a* having a magnet mounting part 51*c* extending in the height direction on the outer circumference, and a stator 51*b* disposed on the outer circumferential side of a magnet of the rotor 51*a* so as to be opposite to the magnet adhered on the outer circumference of the magnet mounting part 51*c* for applying a rotary magnetic field to the rotor 51*a.* A reduction mechanism 40 is incorporated by this drive motor 51.

By thus incorporating the reduction mechanism 40 by the drive motor 51, if the reduction mechanism 40 and drive motor 51 are arranged coaxially, the entire structure may be formed thinly. Thus, any increase of lower volume of the outer casing 31 is suppressed.

Figure 7:
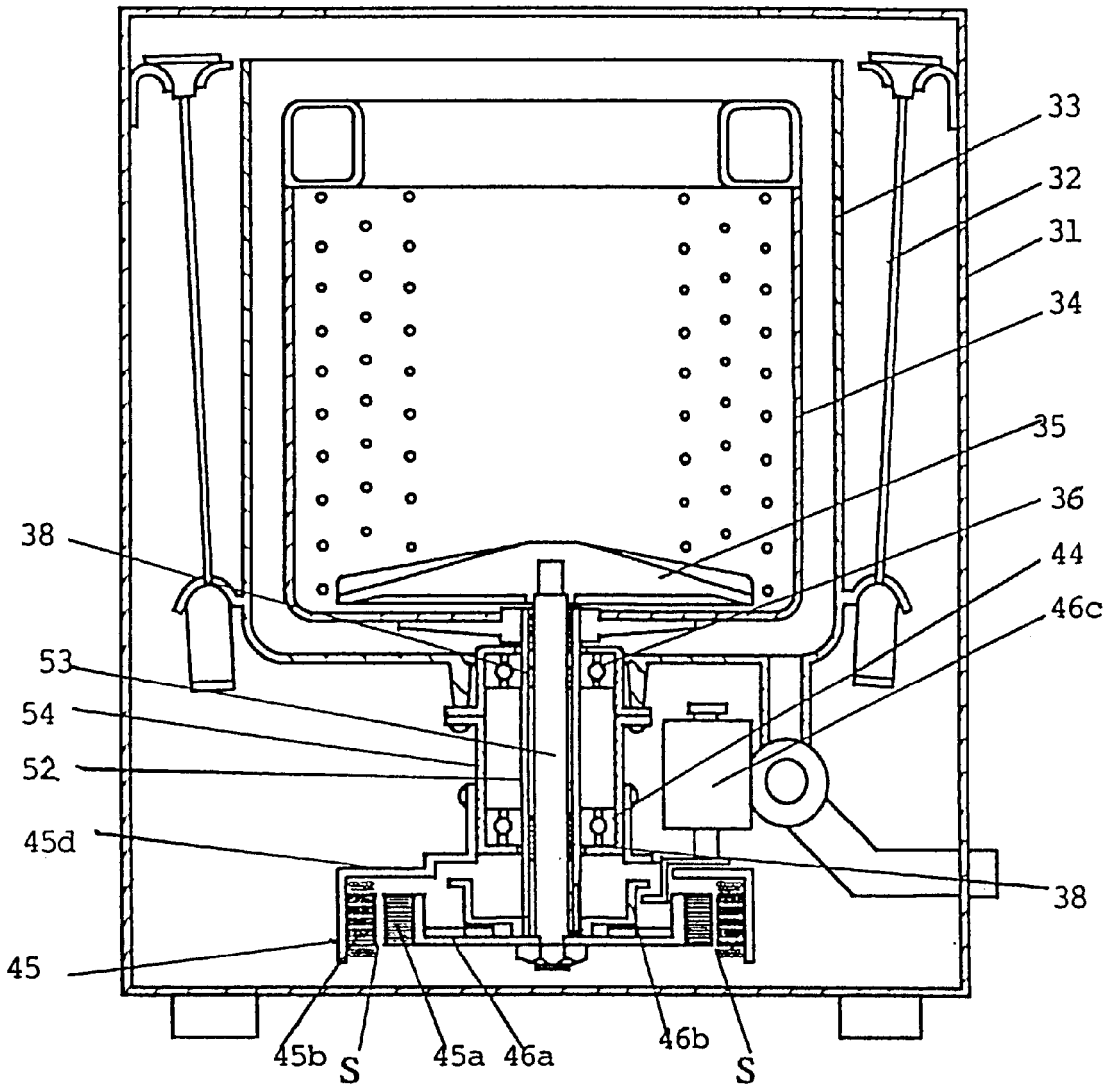
FIG. 7 is a sectional view of a washing machine in a fifth embodiment of the invention.

A fifth embodiment of the invention is described below while referring to FIG. 7. In FIG. 7, the same components as in the first embodiment are identified with the same reference numerals, and a detailed description is omitted.

As shown in FIG. 7, a dewatering shaft 52 is hollow, and is supported by a dewatering bearing 36 provided in the center of the bottom of an outer tank 33. The upper end of this dewatering shaft 52 is fixed to the bottom of a dewatering tank 34, and the dewatering tank 34 is rotated. A washing shaft 53 has its upper end fixed on agitating blades 35 in order to rotate the agitating blades 35. This washing shaft 53 is disposed coaxially in the hollow part of the dewatering shaft 52, and is supported by the washing bearing 38 disposed in the hollow part of the dewatering shaft 52.

The dewatering shaft 52 is incorporated in a case 54 made of upper and lower parts, and the lower part of the dewatering shaft 52 is supported by a dewatering bearing 44 fitted to the lower inner side of the case 54. This case 54 is fixed to the bottom side of the outer tank 33.

A drive motor 45 is for rotating the dewatering shaft 52 and washing shaft 53, and a rotor 45*a* of the drive motor 45 is coupled to the lower part of the washing shaft 53. Inside of the drive motor 45, a stator 45*b* is disposed so as to be opposite to the magnet disposed on the outer circumference of the rotor 45*a,* and a gap S is formed between the stator 45*b* and rotor 45*a.* This gap S is set in consideration of fluctuation of parts such as the outer circumference of the rotor 45*a* rotated by the rotary magnetic field of the stator 45*b* (i.e., so that the magnet may not contact the stator 45*b*), and is defined also in consideration of the eccentric amount of the rotor 45*a* due to the force received during rotation of the output shaft rotated by the drive motor 45, that is, the washing shaft 53 and dewatering shaft 52.

The stator 45*b* is provided inside of a nearly cylindrical stator housing 45*d,* and the stator housing 45*d* is provided at the lower outer side of the case 54 mounting the dewatering bearing 35 at the lower inner side.

A clutch mechanism 46 for transmitting or not transmitting the rotation of the drive motor 45 to the dewatering shaft 52 is partly coupled to the rotor 45*a* of the drive motor 45. That is, the clutch mechanism comprises a torque transmitting unit for transmitting the torque of the rotor 45*a* of the drive motor 45, and a drive unit for contacting or departing from the torque transmitting unit. This torque transmitting unit is composed of a fixed clutch 46*a* formed in part of the rotor 45*a* coupled to the lower part of the washing shaft 53, and a movable clutch 46*b* contacting or departing from the fixed clutch 46*a.* The moveable clutch rotates together with the dewatering shaft 52 by a drive unit 46*c* composed of solenoid and others. The constitution of the clutch mechanism 46 is the same as explained in FIG. 2 relating to the first embodiment, and its detailed description is omitted.

In this constitution, the operation is described below. First, in washing and rinsing stroke, power is supplied to the drive unit 46*c*. Due to the generated magnetic force, the movable clutch 46*b* is moved to the side of the case 54 (that is, upward) and the engagement of the fixed clutch 46*a* and the movable clutch 46*b* is cleared (see FIG. 3(*a*)). As the engagement is cleared, rotation of the rotor 45*a* of the drive motor 45 is not transmitted to the dewatering shaft 52, and is transmitted only to the agitating blades 35 through the washing shaft 53. As a result, mechanical force is applied to the laundry, and agitating operation is carried out. Thus, washing and rinsing of the laundry contained in the dewatering tank 34 are progressed.

After the washing and rinsing stroke, the dewatering stroke begins. In the dewatering stroke, the water in the dewatering tank 34 is discharged, and power supply to the drive unit 46*c* is stopped at the same time. At this time, the movable clutch 46*b* descends along the vertical grooves of the dewatering shaft 52 by its own weight (see FIG. 3(*b*)), and the fixed clutch 46*a* and the movable clutch 46*b* are engaged with each other. Therefore, by the engagement of the fixed clutch 46*a* and the movable clutch 46*b,* the dewatering shaft 52 and rotor 45*a* are coupled with each other, rotation of the rotor 45*a* of the drive motor 45 is transmitted to the dewatering shaft 52, and the agitating blades 35 and the entire dewatering tank 34 rotate together. Due to the centrifugal force generated by rotation of the dewatering tank 34, the water in the laundry after washing and rinsing is wrung out into the outer tank 33 from multiple holes formed in the side of the dewatering tank 34. Thus, the laundry is dewatered automatically.

In this way, the laundry charged in the dewatering tank 34 finishes the full strokes of washing, rinsing and dewatering.

Herein, when assembling the drive motor 45, first a nearly cylindrical stator housing 45*d* mounting the annular stator 45*b* inside is fitted into the lower outer side of the case 43 mounting the dewatering bearing 39 at the lower inner side, and is attached to the lower part of the case 43. Then the rotor 45*a* is inserted so as to be positioned at the inner circumferential side of the annular stator 45*b,* and the rotor 45*a* is fixed in the lower part of the washing shaft 53. Therefore, depending on the mounting position of the stator housing 45*d* or fluctuations of parts, the gap S between the rotor 45*a* and stator 45*b* may not be uniform on the whole circumference, and large gaps and small gaps occur. In the embodiment, however, since the rotor 45*a* is directly coupled with the washing shaft 53, alignment of the rotor 45*a* and washing shaft 53 is not necessary. Moreover, since the washing shaft 53 is disposed coaxially in the hollow dewatering shaft 52 through the washing bearing 38, and the dewatering shaft 52 is held in the case 54 through the dewatering bearing 34, the washing shaft 53 is also held in the case 54, and the rotor 45*a* coupled to the washing shaft 53 is also positioned by the case 54. Moreover, since the stator housing 45*d* for holding the stator 45*b* is positioned by the case 54, the stator 45*b* is also positioned by the case 54. Therefore, both stator 45*b* and rotor 45*a* are positioned by the case 54, and alignment of the stator 45*b* and rotor 45*a* is not necessary, so that assembling is easy.

Still more, the stator housing 45*d* is provided at the lower outer side of the case 54 mounting the dewatering bearing 44 for supporting the dewatering shaft 52 disposing the washing shaft 53 coaxially through the washing bearing 38 at the lower inner side. Thus, the rotor 45*a* is fixed in the lower part of the washing shaft 53 through the inner and outer surfaces of the lower part of the case 54, and the stator 45*b* attached to the inner side of the nearly cylindrical stator housing 45*d* can be properly positioned. Consequently, positioning precision is enhanced, effects of deformation of the case 54 are hardly caused, and the gap S of the rotor 45*a* and stator 45*b* can be decreased.

The rotor 45*a* is directly coupled to the washing shaft 53, and any particular bearing for rotation of the rotor 45*a* is not necessary. Thus, the rotor 45*a* may be rotated freely by the washing shaft 53 supported in the dewatering shaft 52.

Since the rotor 45*a* is held by the washing bearing 38 and dewatering bearing 44, the eccentricity of the rotor 45*a* is suppressed, and the gap S between the rotor 45*a* and stator 45*b* is decreased. Therefore, the torque can be increased without increasing the size of the drive motor 45.

The lower part of the case 54 is pinched between the dewatering bearing 44 and stator housing 45*d,* and the strength of the lower part of the case 54 is substantially increased so as to be hardly deformed. Therefore, the gap S between the rotor 45*a* and stator 45*b* is further decreased. As a result, the torque can be further increased without increasing the size of the drive motor 45.

Meanwhile, clothes collide against the dewatering tank 34, and the dewatering shaft 52 receives an eccentric force. Since rotation of the drive motor 45 is not transmitted to the dewatering shaft 52 in the washing and rinsing stroke by means of the clutch mechanism 46, eccentricity of the dewatering shaft 52 is not transmitted to the drive motor 45. Therefore, eccentricity of the rotor 45*a* of the drive motor 45 is further suppressed.

In the dewatering stroke, the dewatering shaft 52 may possibly receive the eccentric force, but it is supported by the dewatering bearings 36, 44. This force is received by the dewatering bearings 36, 44, so that the eccentricity of the rotor 45*a* of the drive motor 45 is still more suppressed.

Figure 8:
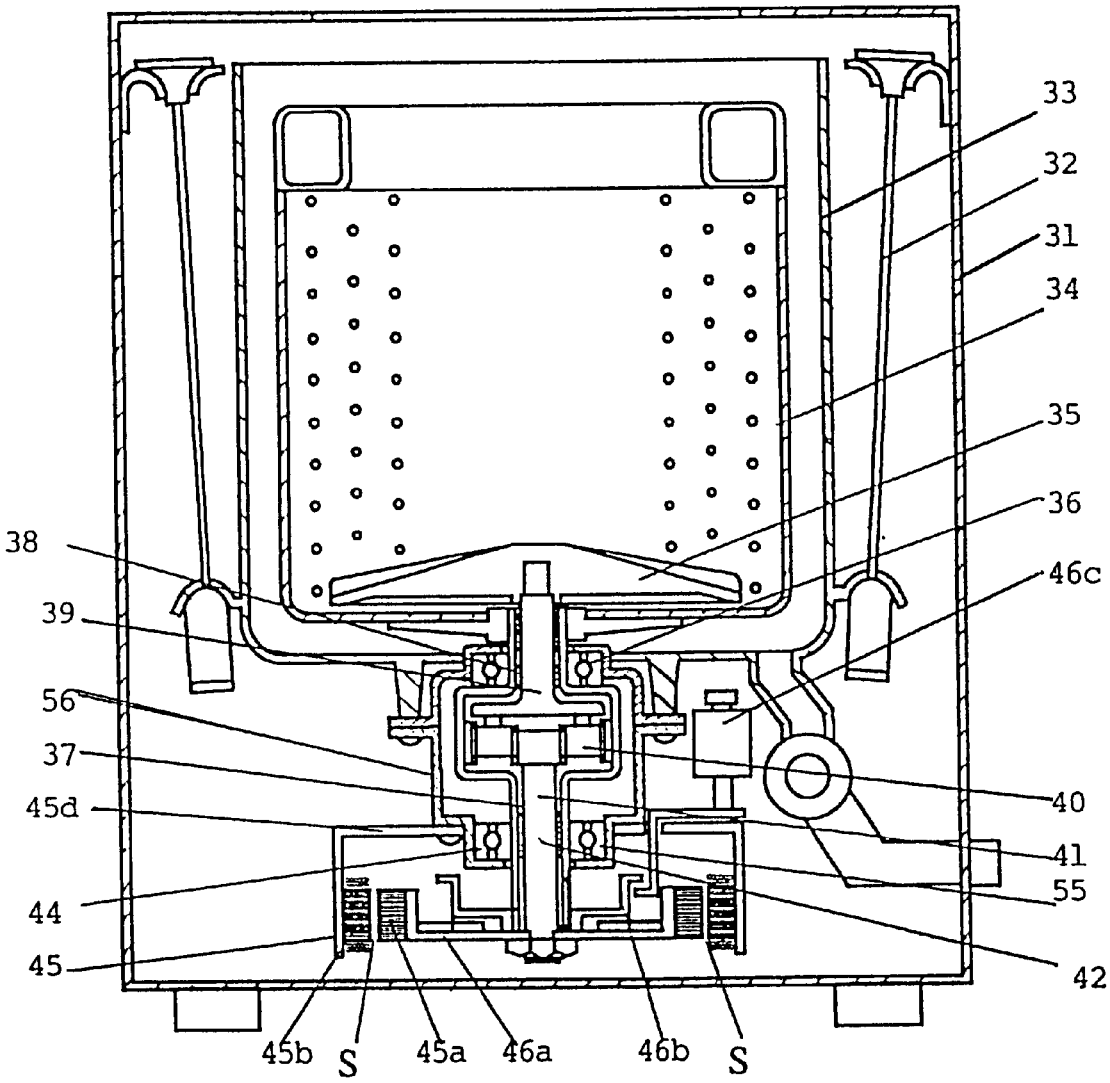
FIG. 8 is a sectional view of a washing machine in a sixth embodiment of the invention.

A sixth embodiment of the invention is described below while referring to FIG. 8. In FIG. 8, the same components as in the fifth embodiment are identified with the same reference numerals, and a detailed description is omitted.

As shown in FIG. 8, a reduction mechanism 40 is incorporated in a dewatering shaft 37, and is designed to reduce the rotating speed by a gear group. In order to prevent abnormal rotation due to imbalance of the dewatering tank 34 in dewatering operation, preferably, the reduction mechanism composed of a planet gear having plural gears arranged in a symmetrical profile is employed. At the output side of this reduction mechanism 40, the washing shaft 39 is connected, and a washing side input shaft 41 is connected to the input side. The washing side input shaft 41 is supported by an input bearing 42 disposed in the lower side hollow part of the dewatering shaft 37. A drive motor 45 is installed so as to rotate the dewatering shaft 37 and the washing side input shaft 41. A dent 55 is formed so as to be curved with respect to the axial central side in the bottom of a case 56, and a dewatering bearing 44 is provided inside of the dent 55. A stator housing 45*d* of the drive motor 45 is provided at the outside of the dent 55.

In this constitution, the operation is described below. First, in washing and rinsing stroke, power is supplied to the drive unit 46*c,* and by the generated magnetic force, the movable clutch 46*b* is moved to the side of the case 56 incorporating the reduction mechanism 40 (that is, upward) and the engagement of the fixed clutch 46*a* and the movable clutch 46*b* is cleared (see FIG. 3(*a*)). As the engagement is cleared, rotation of the rotor 45*a* of the drive motor 45 is not transmitted to the dewatering shaft 37, and is transmitted only to the agitating blades 35 through the washing side input shaft 41, reduction gear 40 and washing shaft 39. As a result, mechanical force is applied to the laundry, and agitating operation is carried out. Thus, washing and rinsing of the laundry contained in the dewatering tank 34 are progressed.

After the washing and rinsing stroke, the dewatering stroke begins. In the dewatering stroke, the water in the dewatering tank 34 is discharged, and power supply to the drive unit 46*c* is stopped at the same time. At this time, the movable clutch 46*b* descends along the vertical grooves of the dewatering shaft 37 by the own weight (see FIG. 3(*b*)), and the fixed clutch 46*a* and the movable clutch 46*b* are engaged with each other. Therefore, by the engagement of the fixed clutch 46*a* and the movable clutch 46*b,* the dewatering shaft 37 and rotor 45*a* are coupled with each other, rotation of the rotor 45*a* of the drive motor 45 is transmitted to the dewatering shaft 37, and the agitating blades 35 and the entire dewatering tank 34 rotate together. Due to the centrifugal force generated by rotation of the dewatering tank 34, the water in the laundry after washing and rinsing is wrung out into the outer tank 33 from multiple holes formed in the side of the dewatering tank 34. Thus, the laundry is dewatered automatically.

In this way, the laundry charged in the dewatering tank 34 finishes the full strokes of washing, rinsing and dewatering.

In the washing and rinsing stroke, for example, when the rotation of the rotor 45*a* of the drive motor 45 and the washing side input shaft 41 is reduced to ⅙ by the reduction mechanism 40 and is transmitted to the washing shaft 39 and agitating blades 35 (ignoring the transmission efficiency) the torque is about six times larger than before reduction. Thus, in the structure of coupling the washing shaft 39 and washing side input shaft 41 through the reduction mechanism 40, if the torque of the drive motor 45 is small, the torque for rotating the agitating blades 35 can be increased. Thus, an increase of washing capacity and enhancement of cleaning performance can be realized without increasing the torque of the drive motor 45.

The lower part of the case 56 for incorporating the reduction mechanism 40 is curved to the axial center side, and a dent 55 is formed. In the relation between the outside diameter of the reduction mechanism 40 and the outside diameter of the lower part of the dewatering shaft 37, the dent 55 may be formed easily without particularly increasing the outside diameter of the case 56. The dewatering bearing 44 is fitted inside of the dent 55, and the stator housing 45*d* is formed on the outer circumference of the dent 55. Therefore, the stator housing 45*d* can be positioned in the vertical direction in the dent 55, so that the drive motor 45 may be assembled easily.

Moreover, since the dent 55 is formed integrally in the lower part of the case 56, the rigidity of the entire case 56 is increased, and the dent 55 is hardly deformed. Therefore, at the inner and outer sides of the dent 55, the dewatering bearing 44 and stator housing 45*d* can be positioned (that is, the rotor 45*a* coupled to the input bearing 42 disposed coaxially in the hollow part of the dewatering shaft 37 supported by the dewatering bearing 44) and the stator 45*b* provided in the stator housing 45*d* can be positioned. Therefore, not only the positioning precision is improved, but also the dent 55 is hardly deformed, and the deforming force is less, and the gap S between the rotor 45*a* and stator 45*b* can be further decreased. Therefore, the size of the drive motor 45 is decreased, while the torque can be increased.

Figure 9:
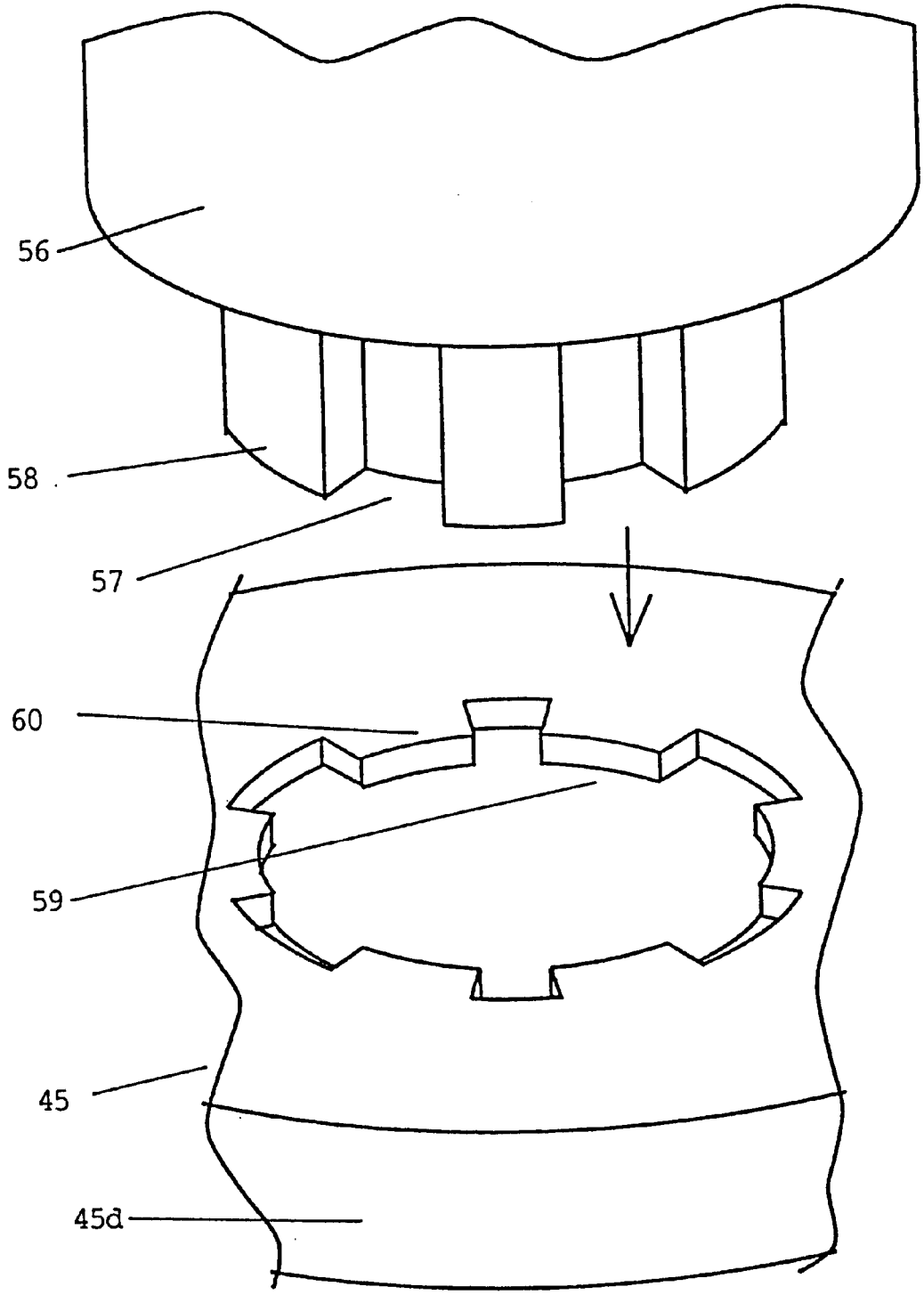
FIG. 9 is an essential perspective exploded view of a washing machine in a seventh embodiment of the invention.

A seventh embodiment of the invention is described below while referring to FIG. 9. In FIG. 9, the same components as in the sixth embodiment are identified with the same reference numerals, and a detailed description is omitted.

As shown in FIG. 9, a case 56 has a bump 58 provided on an outer surface 57 of a nearly cylindrical form in the lower part in the axial direction. In the middle of a stator housing 45*d* of a drive motor 45, a nearly cylindrical opening 59 is provided, and a recess 60 to be fitted with the bump 58 is formed in the inner side of this opening 59.

In this constitution, the mutually fitting bump and recess 58, 60 are formed in the outer surface 57 of nearly cylindrical shape in the lower part of the case 56 and the inner side of the opening 59 of the stator housing 45*d* which are fitted to each other. Therefore, when the rotor 45*a* rotates, the rotation reaction generated in the stator 45*b* and stator housing 45*d* can be received by the bump and recess 58, 60, so that it is possible to withstand a larger rotating torque of the drive motor 45.

Moreover, the bump and recess 58, 60 are positioned in the rotating direction when fitting the outer surface 57 of nearly cylindrical form in the lower part of the case 56 into the opening 59 of the stator housing 45*d.* Thus, positioning can be adjusted automatically when fixing the stator housing 45*d* to the case 56 with a screw from the side, and assembling is very easy.

Also by the bump and recess 58, 60, the rigidity of the lower part of the case 56 and the stator housing 45*d* can be increased, and the strength is further improved. Therefore, deformation of the lower part of the case 56 and the stator housing 45*d* during rotation of the rotor 45*a* is decreased, and the gap S between the rotor 45*a* and stator 45*b* is further narrowed.

Figure 10:
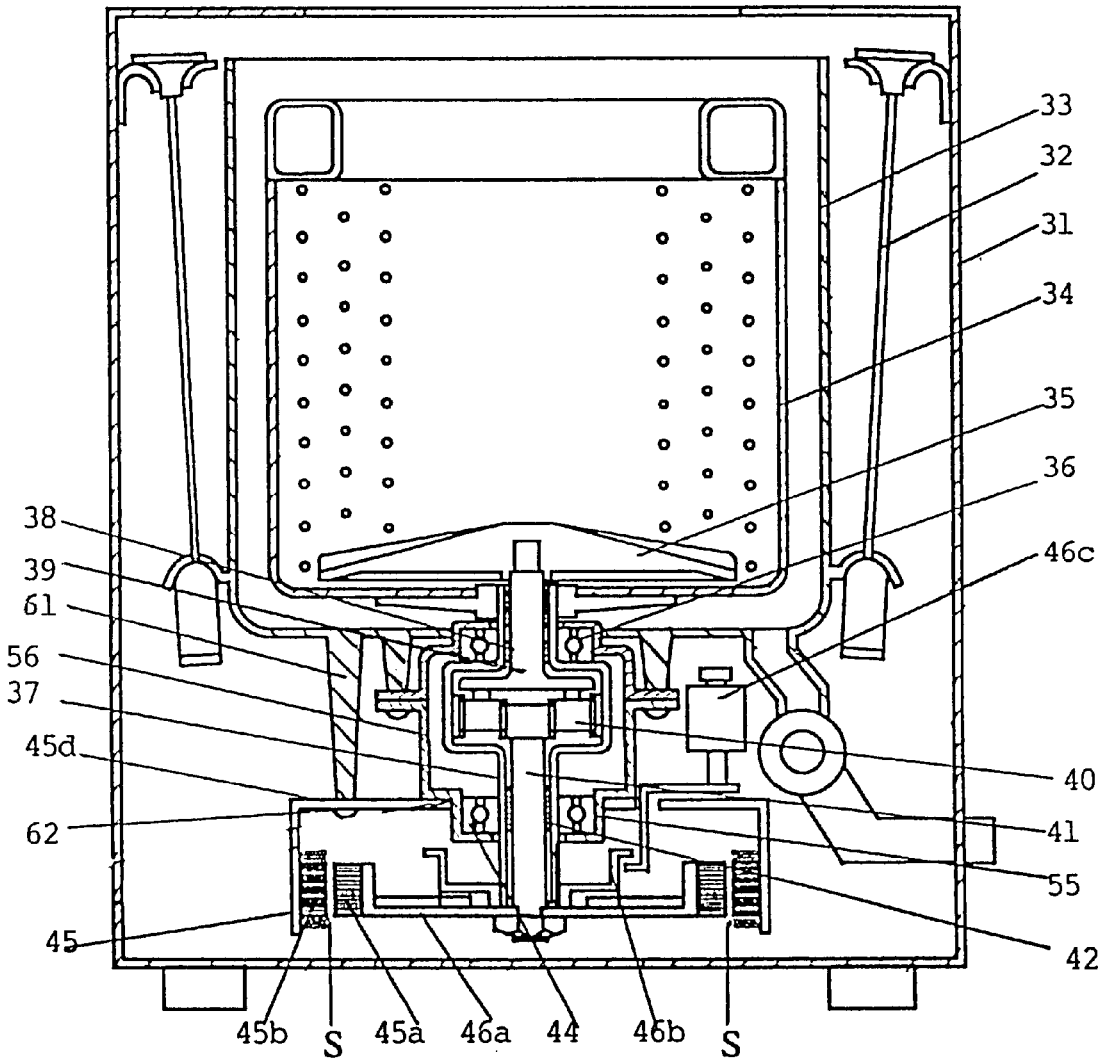
FIG. 10 is a sectional view of a washing machine in an eighth embodiment of the invention.

An eighth embodiment of the invention is described below while referring to FIG. 10. In FIG. 10, the same components as in the sixth embodiment are identified with the same reference numerals, and a detailed description is omitted.

As shown in FIG. 10, a stator housing 45*d* of the drive motor 45 is composed so as to hold the top panel center by fitting it to the root of a dent 55 curved to the axial central side in the lower part of a case 56. A boss 61 is formed integrally from the bottom of an outer tank 33, a mounting part 62 formed on the top panel outer circumference of the stator housing 45*d* is fitted to the boss 61, and the stator housing 45*d* is fixed directly to the outer tank 33 through the boss 61.

In this constitution, the top panel center of the stator housing 45*d* is fitted to the root of the dent 55 curved to the axial central side in the lower part of the case 56, and the top panel outer circumference of the stator housing 45*d* is directly fitted to the outer tank 33 through the boss 61. Therefore, as compared with the structure of being held in the outer tank 33 through the case 56 as being fixed to the case 56, the stability of the stator housing 45*d* during rotation of the rotor 45*a* is improved, and the oscillation is decreased so that stable rotation of the washing side input shaft 41 and rotor 45*a* is obtained. In addition, the gap S between the rotor 45*a* and stator 45*b* is further narrowed, and the torque can be increased without increasing the size of the drive motor 45.

Figure 11:
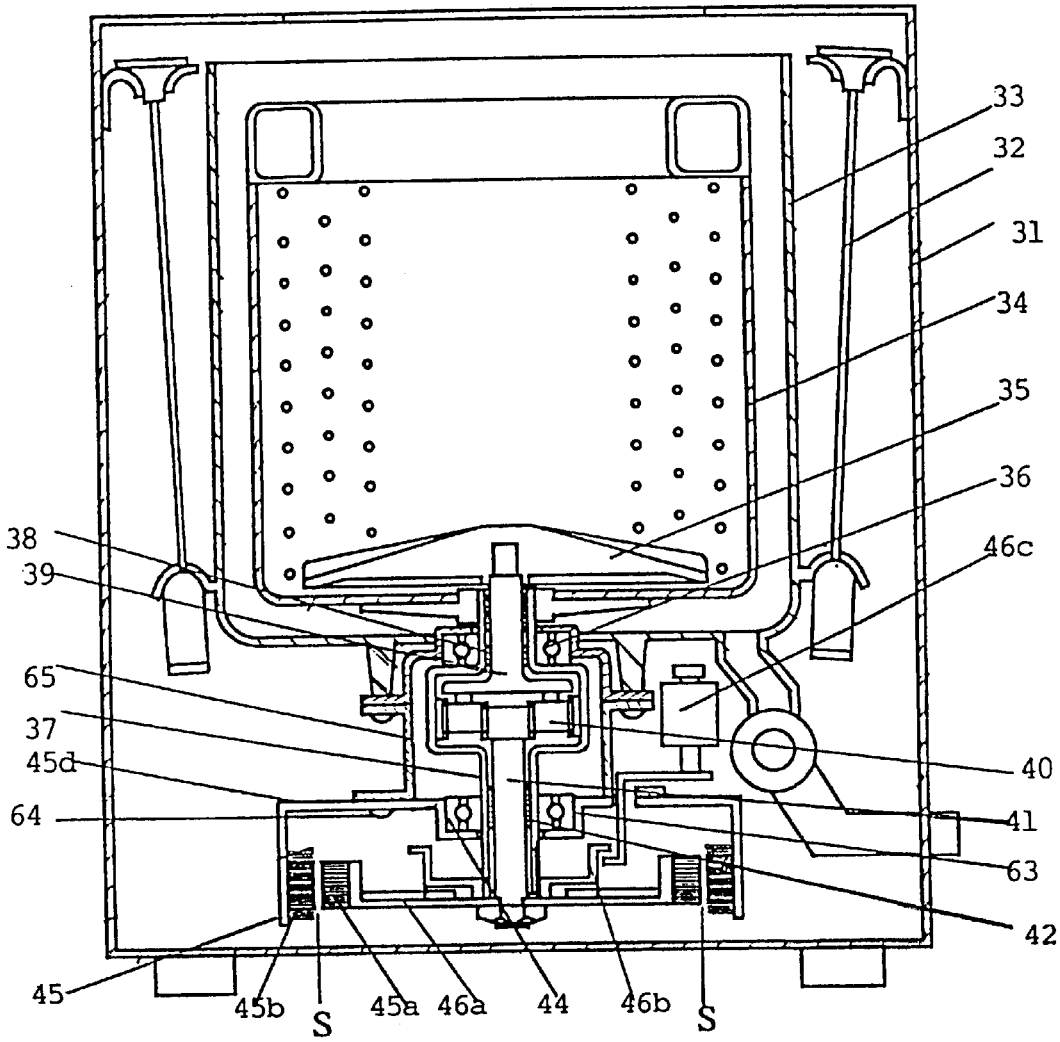
FIG. 11 is a sectional view of a washing machine in a ninth embodiment of the invention.

A ninth embodiment of the invention is described below while referring to FIG. 11. In FIG. 11, the same components as in the sixth embodiment are identified with the same reference numerals, and a detailed description is omitted.

As shown in FIG. 11, a stator housing 45*d* of a drive motor 45 has an accommodating part 63 provided on the top panel center, and a dewatering bearing 44 is contained in this accommodating part 63. A mounting part 64 is provided in the stator housing 45*d,* and it is fitted to a case 65.

In this constitution, the accommodating part 63 for containing the dewatering bearing 44 is provided on the top panel center of the stator housing 45*d* of the drive motor 45. Therefore, the stator 45*b* and the dewatering bearing 44 can be held by one stator housing 45*d,* and the positioning precision of the stator 45*b* and the rotor 45*a* supported on the dewatering bearing 44 through a washing side input shaft 41 and a dewatering shaft 37 can be further enhanced. In addition, the gap S of the stator 45*b* and rotor 45*a* is smaller, so that the torque can be increased without increasing the size of the drive motor 45.

Moreover, since the lower part of the case 65 is not holding the dewatering bearing 44, the lower part can be opened toward the outside, and the case 65 can be fixed to the mounting part 64 of the top panel of the stator housing 45*d*. Therefore, oscillation of the stator housing 45*d* during rotation of the rotor 45*a* is smaller, so that a stable rotation of the rotor 45*a* is obtained, and the gap S of the rotor 45*a* and stator 45*b* is smaller, so that the torque can be increased without increasing the size of the drive motor 45.

Figure 12:
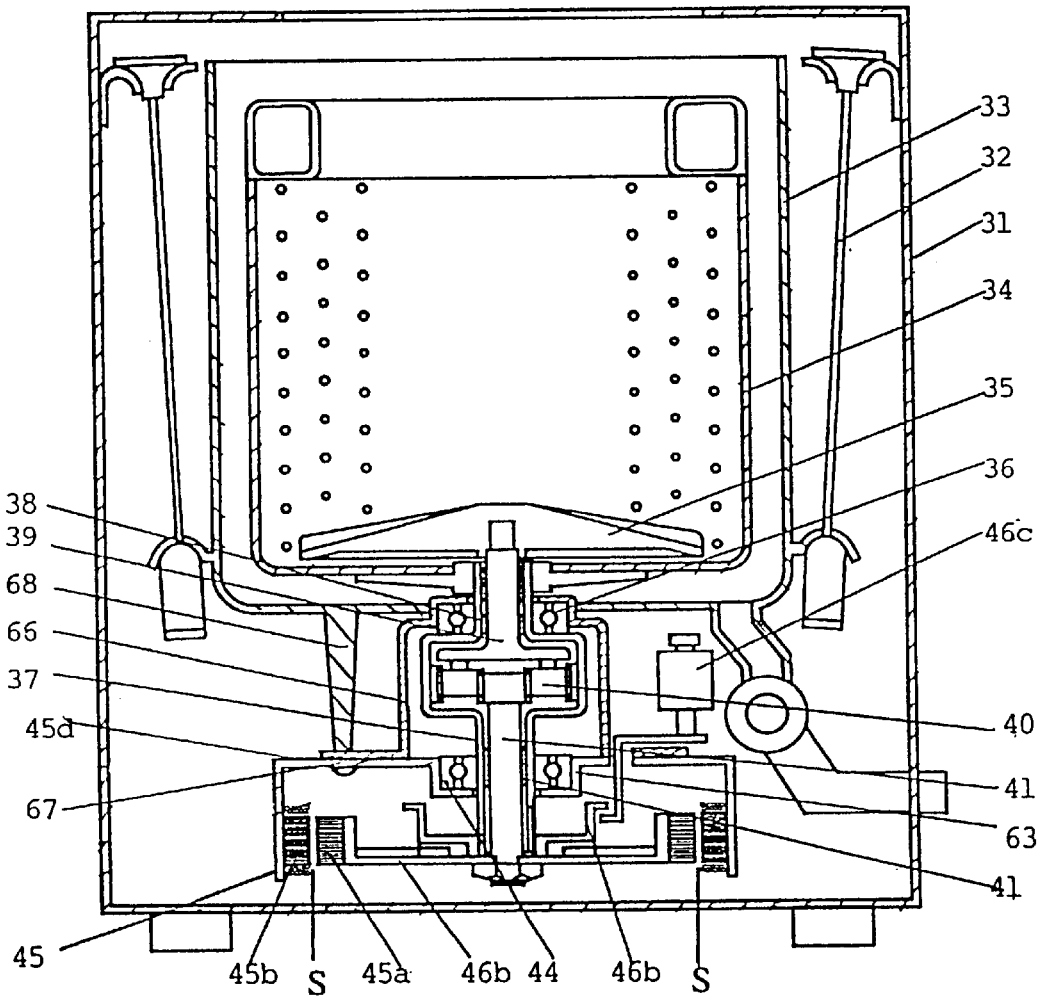
FIG. 12 is a sectional view of a washing machine in a tenth embodiment of the invention.

A tenth embodiment of the invention is described below while referring to FIG. 12. In FIG. 12, the same components as in the sixth embodiment are identified with the same reference numerals, and a detailed description is omitted.

As shown in FIG. 12, a case 66 has its bottom opened to the outside, and is fixed to a boss 68 formed integrally from the bottom of an outer tank 33, together with a mounting part 67 provided on the top panel outer circumference of a stator housing 45*d* of a drive motor 45.

In this constitution, since the case 66 is fixed to the outer tank 33 through the boss 68 of the outer tank 33 from the bottom opened to the outside, it is not necessary to fix the case 66 to the outer tank 33 at another position, and the case structure is simple and is composed of one component.

Moreover, since the case 66 and stator housing 45*d* are fixed together with the boss 68 formed integrally from the bottom of the outer tank 33, the case 66 and stator housing 45*d* can be mounted simultaneously on the outer tank 33, and assembling is easy.

All of the parts located beneath the outer tank 33 (that is, the case 66, dewatering shaft 37, stator housing 45*d*, and rotor 45*a*) can be mounted in one direction only from bottom to top, and assembling is further simplified.

The stator housing 45*d* is fixed directly to the outer tank 33 through the boss 68, the stability of the stator housing 45*d* during rotation of the rotor 45*a* is improved, oscillation is smaller, and a stable rotation of the washing side input shaft 41 and rotor 45*a* is obtained. Furthermore, the gap S of the rotor 45*a* and stator 45*b* is smaller, so that the torque can be increased without increasing the size of the drive motor 45.

Figure 13:
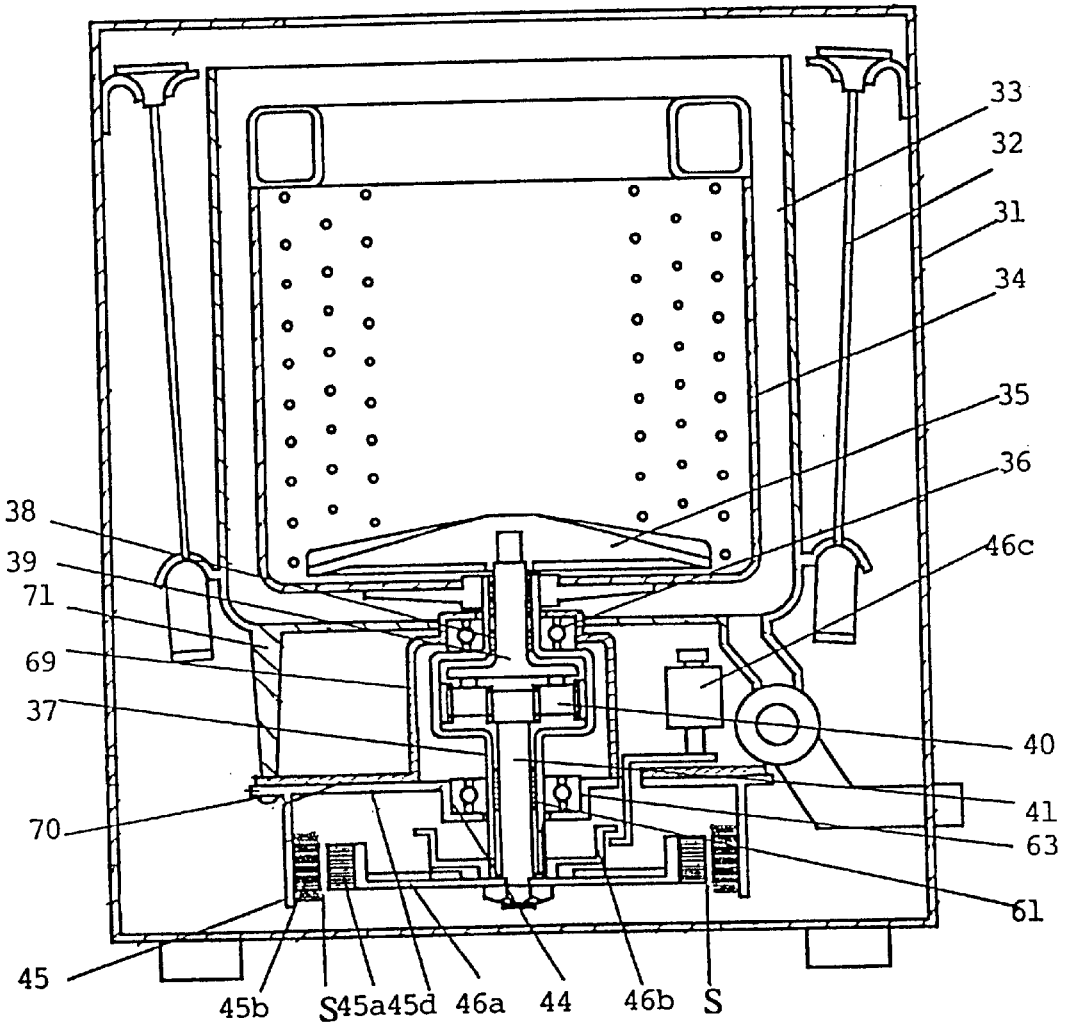
FIG. 13 is a sectional view of a washing machine in an eleventh embodiment of the invention.

An eleventh embodiment of the invention is described below while referring to FIG. 13. In FIG. 13, the same components as in the sixth embodiment are identified with the same reference numerals, and a detailed description is omitted.

As shown in FIG. 13, a case 69 has its bottom opened to the outside, and is fixed to a boss 71 formed integrally from the bottom of an outer tank 33, together with a mounting part 70 provided on the top panel outer circumference positioned outside from the side of a stator housing 45*d* of a drive motor 45.

In this constitution, since the stator housing 45*d* is fixed to the outer tank 33 through the boss 71, from the mounting part 70 provided on the top panel outer circumference positioned outside of its side, oscillation of the stator housing 45*d* during rotation of the rotor 45*a* is smaller. In addition, the gap S of the rotor 45*a* and stator 45*b* is smaller so that the torque can be increased without increasing the size of the drive motor 45.

Moreover, since the top panel outer circumference of the stator housing 45*d* having the mounting part 70 to the outer tank 33 is positioned outside of its side, when mounting the stator housing 45*d* on the outer tank 33, its position is inside of the stator housing 45*d* and it cannot be assembled unless it is always positioned inside of the stator 45*b*. Therefore, it can be easily installed in the outer tank 33, regardless of the size of the stator 45*b*, without damaging the stator 45*b* and others in the stator housing 45*d*.

Figure 14:
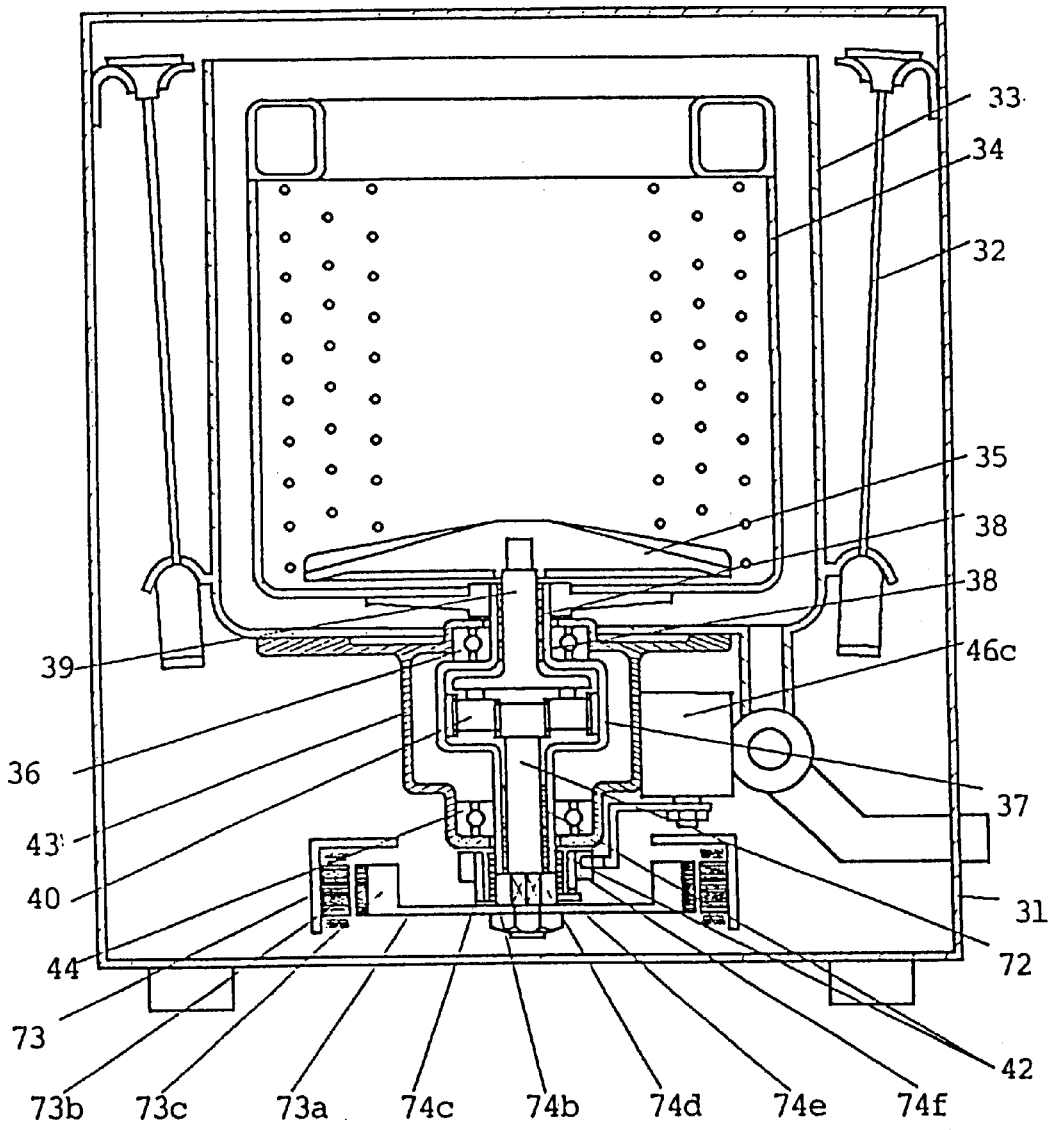
FIG. 14 is a sectional view of a washing machine in a twelfth embodiment of the invention.

A twelfth embodiment of the invention is described below while referring to FIG. 14 and FIG. 15. In FIG. 14, the same components as in the first embodiment are identified with the same reference numerals, and a detailed description is omitted.

As shown in FIG. 14, a drive motor 73 is mounted on a washing side input shaft 72 of a reduction mechanism 40. The drive motor 73 is composed of a disk-shaped rotor 73*a* having a magnet mounting part 73*c* extended in the height direction on its outer circumference. A stator 73*b* for applying a rotary magnetic field to the rotor 73 a is disposed on the outer circumferential side of the magnet of the rotor 73*a* so as to be opposite to the magnet adhered on the outer circumference of the magnet mounting part 73*c*. The washing side input shaft 72 of the reduction mechanism 40 is coupled to the center of rotation of the rotor 73*a* of the drive motor 73.

Figure 15:
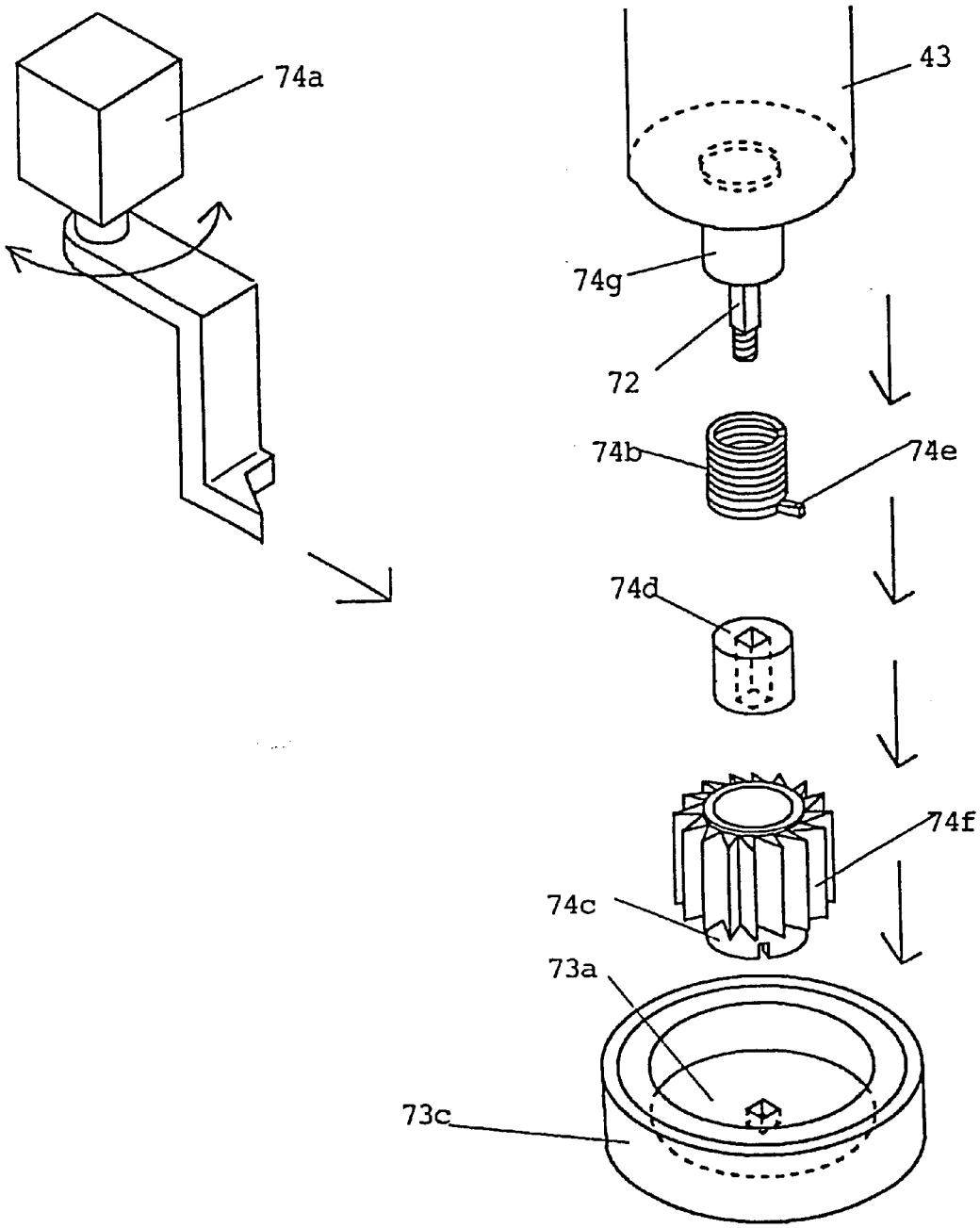
FIG. 15 is a perspective exploded view showing a constitution of a drive unit of the washing machine of the twelfth embodiment of the invention.

A clutch mechanism 74 is, as shown in FIG. 15, composed of a torque transmitting unit for transmitting the torque of the drive motor 73, and a drive unit for fixing or releasing the torque transmitting unit. More specifically, the torque transmitting unit includes a clutch input boss 74*d* provided in a space enclosed by the rotor 73*a* and magnet mounting part 73*c*, a clutch output boss 74*g* provided on the dewatering shaft 37, a clutch spring 74*b* for fixing and releasing, a release sleeve 74*c* fitted to the control pawl 74*e* of the clutch spring 74*b* for defining the motion of the control pawl 74*e*, and a clutch driving means 74*a* engaged with a stopper 74*f* of the release sleeve 74*c* for controlling rotation and stopping of the release sleeve 74*c*.

In this constitution, the operation is described below. In the washing and rinsing stroke, power supply to the clutch driving means 74*a* for operating the clutch mechanism 74 is stopped. The clutch driving means 74*a* is engaged with the stopper 74*f* of the release sleeve 74*c*, and the release sleeve 74*c* cannot rotate freely. The control pawl 74*e* of the clutch spring 74*b* fitted into the release sleeve 74*c* is fixed, and the clutch spring 74*b* loosens the tightening between the clutch input boss 74*d* fitted into the washing side input shaft 72 and the clutch output boss 74*g* provided in the dewatering shaft 37, so that the torque may not be transmitted. The power of the drive motor 73 is transmitted only to the agitating blades 35 through the washing shaft 39, and a mechanical force is applied to the laundry. In this manner, washing and rinsing of the laundry contained in the dewatering tank 34 are progressed.

After the washing and rinsing stroke, the dewatering stroke begins automatically. In this dewatering stroke, the water in the dewatering tank 34 is discharged, and power is supplied to the clutch driving means 74*a* for moving the clutch mechanism 74. The clutch driving means 74*a* is released from the stopper 74*f* of the release sleeve 74*c*, so that the release sleeve 74*c* is free to rotate. As a result, the control pawl 74*e* of the clutch spring 74*b* fitted in the release sleeve 74*c* is set free, and the clutch spring 74*b* tightens the clutch input boss 74*d* fitted into the washing side input shaft 72 and the clutch output boss 74*g* provided in the dewatering shaft 37 so that the torque may be transmitted. The washing side input shaft 72 and the dewatering shaft 37 are coupled, and the dewatering tank 34 is put in rotation. As the dewatering tank 34 rotates, the water in the laundry after washing and rinsing is wrung out into the outer tank 33 from multiple holes provided in the side of the dewatering tank 34 by centrifugal force. Thus, the laundry is dewatered automatically.

In this way, the laundry charged in the dewatering tank 34 automatically finishes the strokes of washing, rinsing and dewatering.

Thus, according to the embodiment, the washing shaft 39 and dewatering shaft 37 are in a coaxial double structure, and from the side of the agitating blades 35, the reduction mechanism 40, clutch mechanism 74, and drive motor 73 are arranged sequentially. Since they are provided on the same axial line, the drive motor 73 and mechanical section are integrated, and the center of gravity comes to the center of the outer tank 33, thereby eliminating the imbalance as experienced in the prior art when the drive motor is not located in the center of the outer tank 33, and further suppressing vibration when dewatering. Moreover, since the reduction gear 40 and dewatering shaft 37 are directly rotated by the drive motor 73, the conventional belt is not necessary, and problems of belt slip and durability do not exist.

Moreover, part of the torque transmitting unit of the clutch mechanism 74 (that is, the clutch input boss 74*d*) is enclosed in the rotor 73*a* of the drive motor 73. Therefore, the washing machine reduced in thickness and size is presented.

The type of the drive motor 73 is not limited to the constitution of the embodiment as far as a space is formed inside the rotor 73*a* of the drive motor 73.

Figure 16:
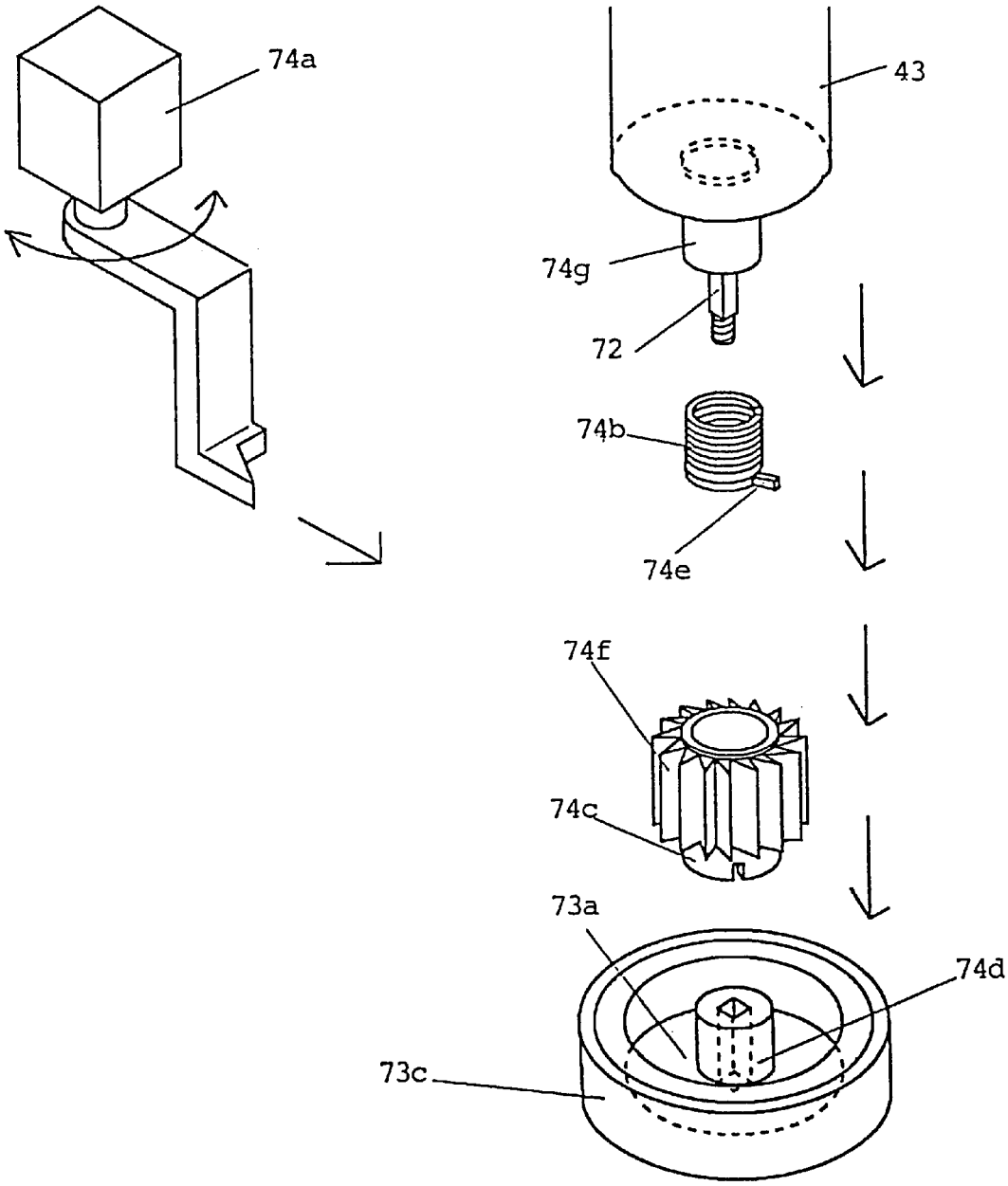
FIG. 16 is a perspective exploded view showing a constitution of a drive unit of a washing machine in a thirteenth embodiment of the invention.

A thirteenth embodiment of the invention is described below while referring to FIG. 16. In FIG. 16, the same components as in the twelfth embodiment are identified with the same reference numerals, and a detailed description is omitted.

As shown in FIG. 16, a clutch input boss 74*d* is part of a clutch mechanism 74, and this clutch input boss 74*d* is integrated with a rotor 73*a* of a drive motor 73.

In this constitution, the rotor 73*a* of the drive motor 73 is formed at a high precision in a coaxial structure. Since the torque is transmitted directly without passing through the washing side input shaft 72, a high torque can be transmitted to the dewatering shaft 37, the dewatering tank 34 can be rotated at high torque, and the starting time is shortened, so that a washing machine not causing starting failure due to bubbles can be presented.

Figure 17:
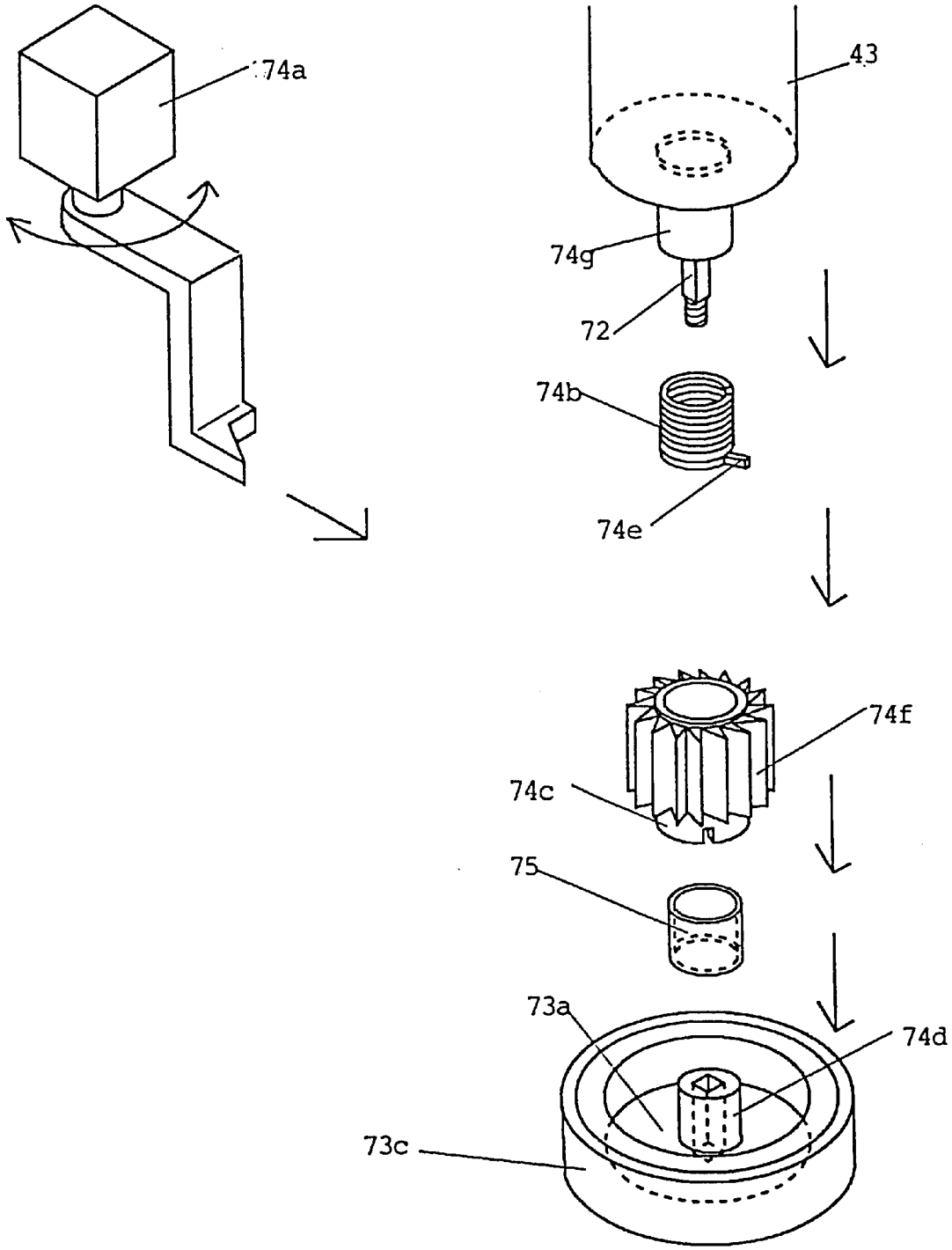
FIG. 17 is a perspective exploded view showing a constitution of a drive unit of a washing machine in a fourteenth embodiment of the invention.

A fourteenth embodiment of the invention is described below while referring to FIG. 17. In FIG. 17, the same components as in the twelfth embodiment are identified with the same reference numerals, and a detailed description is omitted.

As shown in FIG. 17, a clutch input boss 74*d* is part of a clutch mechanism 74. This clutch input boss 74*d* is integrated with a rotor 73*a* of a drive motor 73, and the surface of the clutch input boss 74*d* is covered with a clutch boss ring 75 of other material.

In this constitution, a material excellent in abrasion resistance which is a required characteristic for the clutch input boss 74*d*, and a material excellent in toughness, light in weight and superior in processability as required for the rotor 73*a* of the drive motor 73 can be separately selected.

Figure 18:
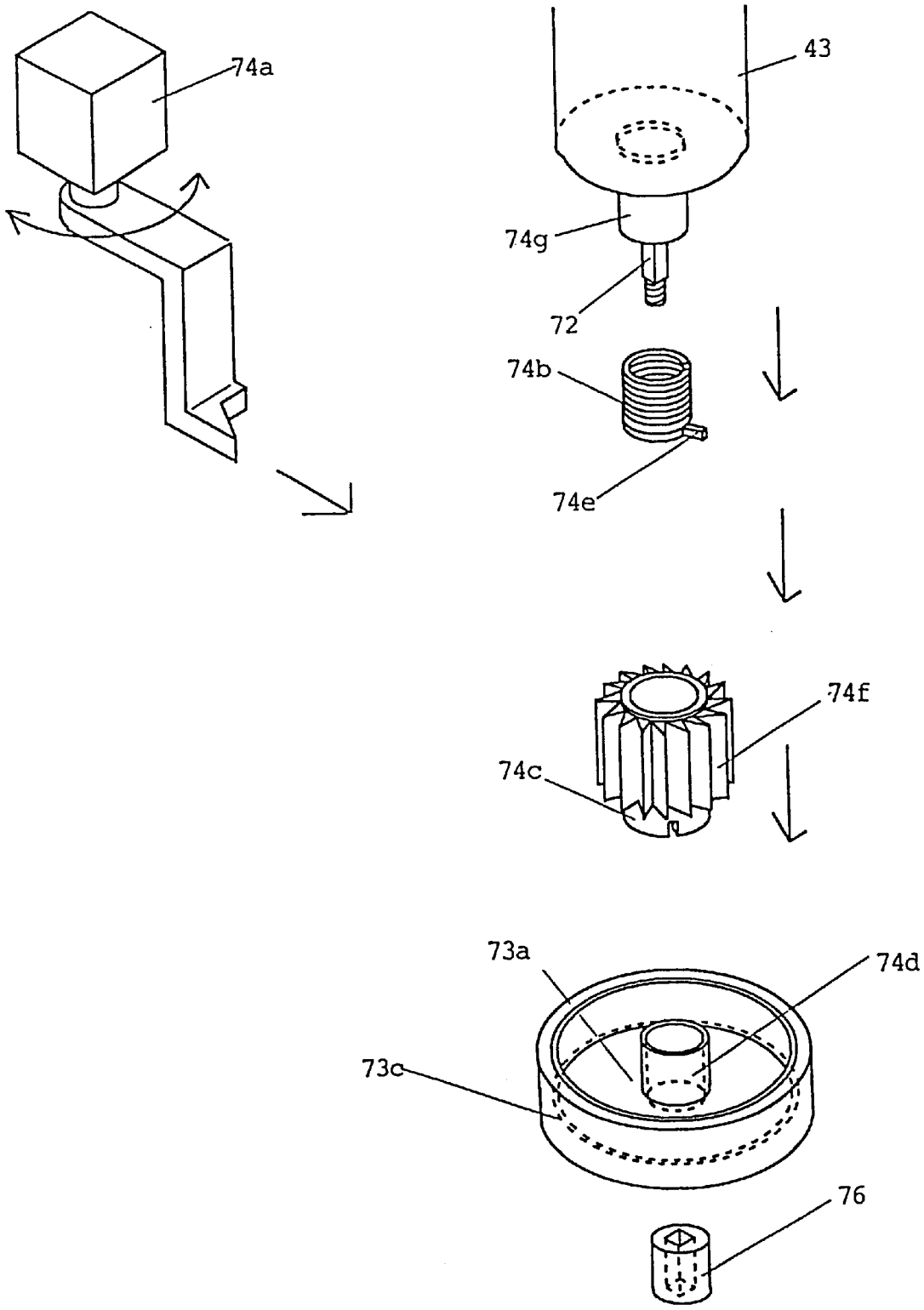
FIG. 18 is a perspective exploded view showing a constitution of a drive unit of a washing machine in a fifteenth embodiment of the invention.

A fifteenth embodiment of the invention is described below while referring to FIG. 18. In FIG. 18, the same components as in the twelfth embodiment are identified with the same reference numerals, and a detailed description is omitted.

As shown in FIG. 18, a clutch input boss 74*d* is a thin magnetic material, integrated with a rotor 73*a* of a drive motor 73, and the rotor 73*a* is formed by press-fitting a rotor boss 76.

In this constitution, the rotor 73*a* and the clutch input boss 74*d* can be fabricated by the same die, the precision of parts is enhanced, the number of parts is curtailed, the assembling performance is enhanced, and the clutch mechanism 74 is reduced in thickness and size.

Figure 19:
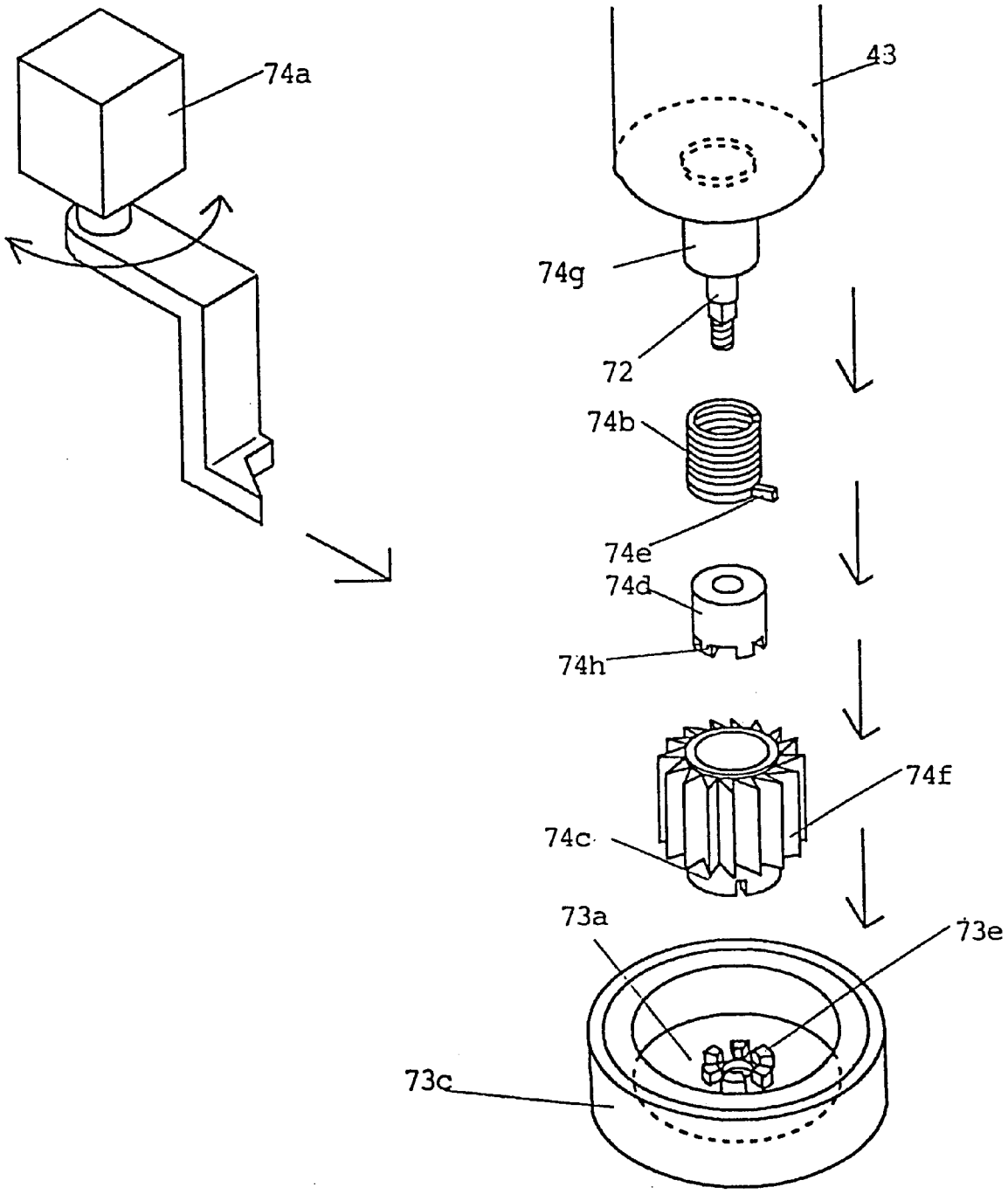
FIG. 19 is a perspective exploded view showing a constitution of a drive unit of a washing machine in a sixteenth embodiment of the invention.

A sixteenth embodiment of the invention is described below while referring to FIG. 19. In FIG. 19, the same components as in the twelfth embodiment are identified with the same reference numerals, and a detailed description is omitted.

As shown in FIG. 19, engaging clutches 74*h*, 73*e* are provided to be engaged respectively with a rotor 73*a* of a drive motor 73 and a clutch input boss 74*d*. Due to their engagement with each other, the torque generated in the rotor 73*a* of the drive motor 73 is transmitted to the clutch input boss.

In this constitution, due to engagement of the engaging clutches 74*h*, 73*e* provided at the rotor 73*a* of the drive motor 73 and the clutch input boss 74*d*, the torque of the rotor 73*a* can be transmitted to the clutch input boss 74*d* through the engaging clutches 73*e*, 74*h* without passing through the washing side input shaft 72. Therefore, the mounting hole of the clutch input boss 74*d* and washing side input shaft 72 may be a round hole, and the dewatering tank 34 is rotated at high torque regardless of the strength of the washing side input shaft 72.

Figure 20:
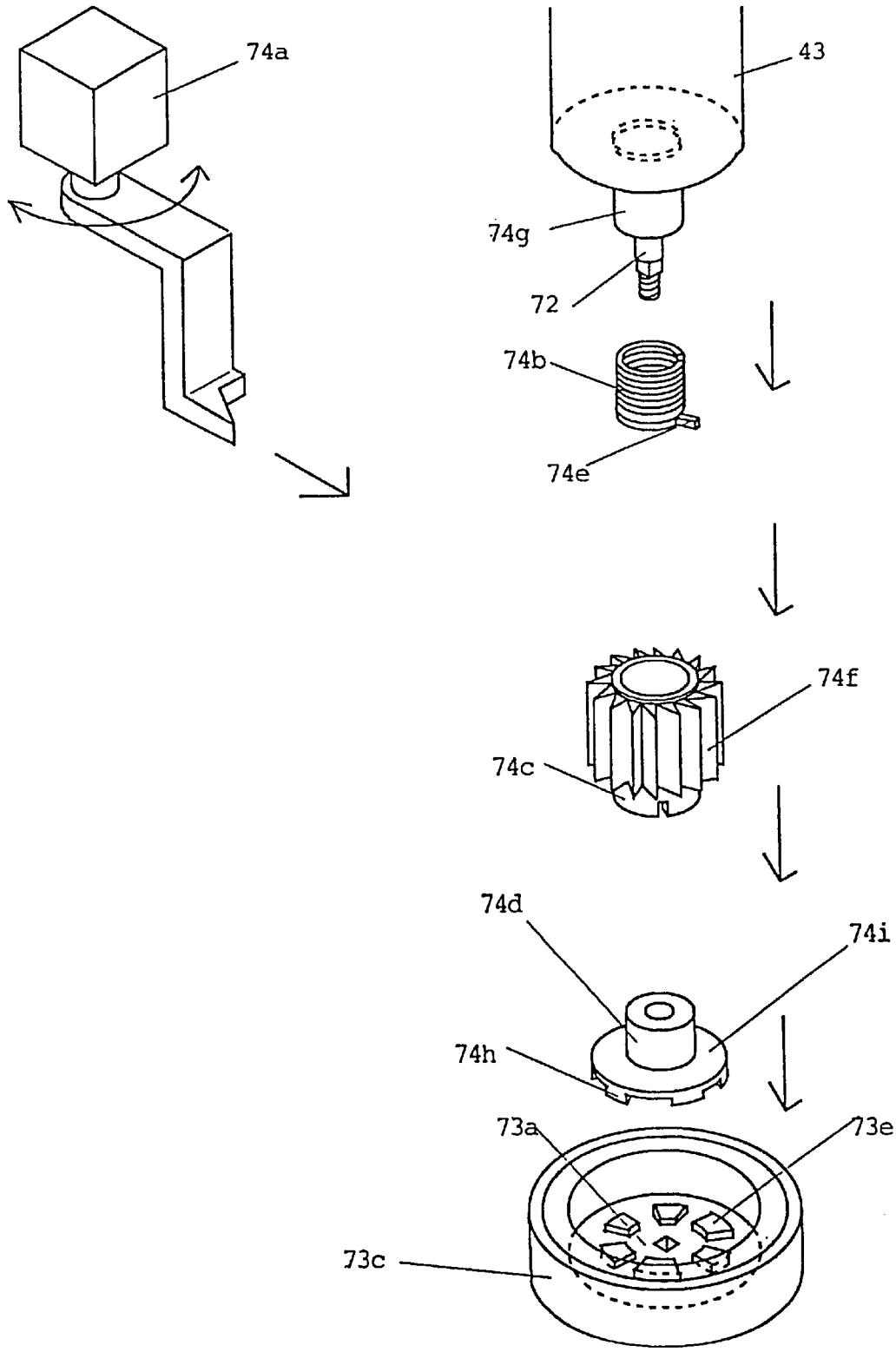
FIG. 20 is a perspective exploded view showing a constitution of a drive unit of a washing machine in a seventeenth embodiment of the invention.

A seventeenth embodiment of the invention is described below while referring to FIG. 20. In FIG. 20, the same components as in the twelfth embodiment are identified with the same reference numerals, and a detailed description is omitted.

As shown in FIG. 20, an engaging clutch 73*e* is formed in a rotor 73*a* of a drive motor 73, a flange 74*i* is formed in a clutch input boss 74*d*, and an engaging clutch 74*h* for transmitting torque is provided outside of the boss outside diameter.

In this constitution, the engaging clutches 73*e*, 74*h* have a certain distance provided in the radial direction. Therefore, the shearing force is smaller, inexpensive materials may be used for the rotor 73*a* and flange 74*i* of the clutch input boss 74*d*, and run-out of the rotor 73*a* can be curbed by the flange 74*i* of the clutch input boss 74*d* so that driving at high torque is realized.

Figure 21:
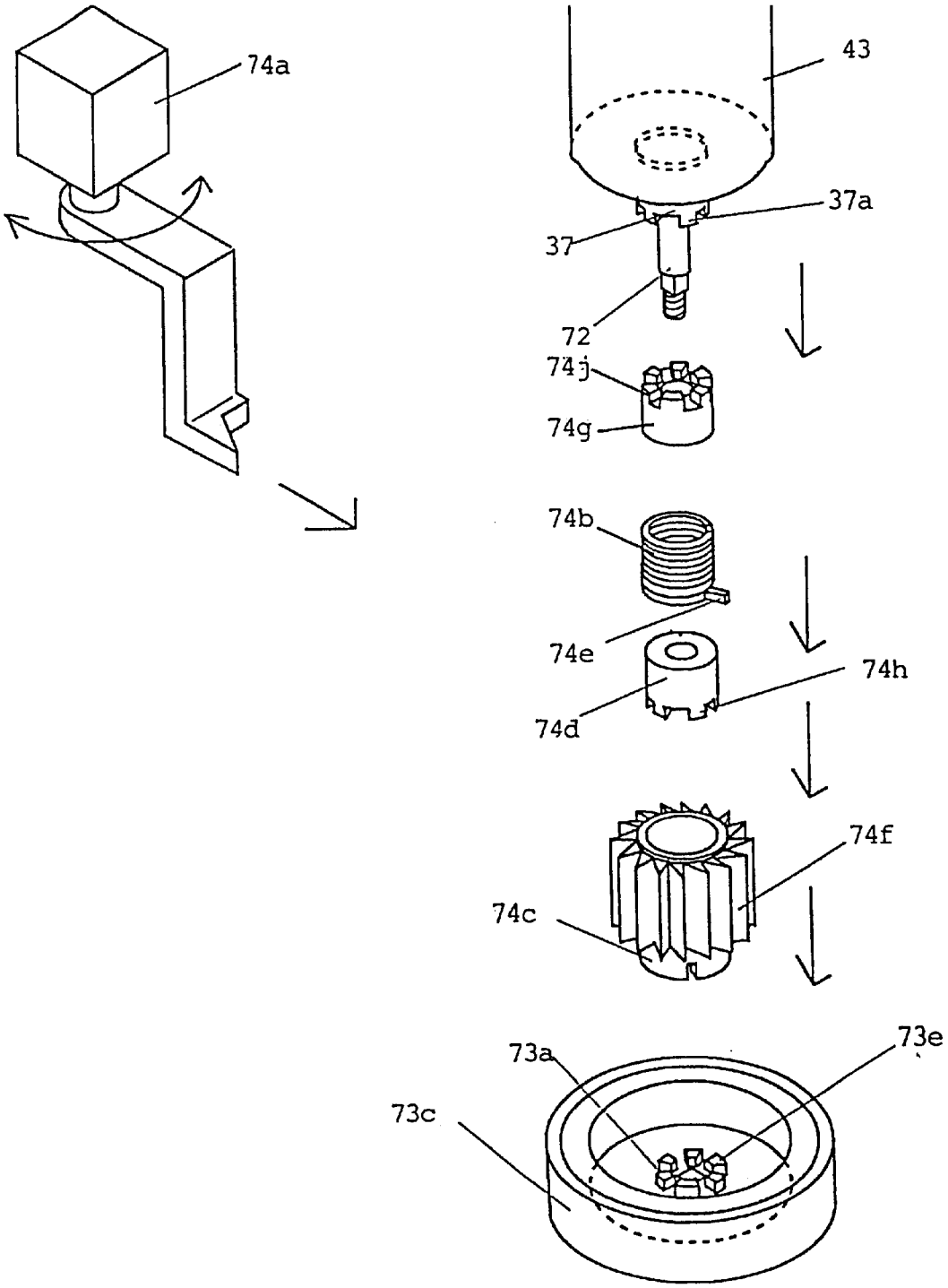
FIG. 21 is a perspective exploded view showing a constitution of a drive unit of a washing machine in an eighteenth embodiment of the invention.

An eighteenth embodiment of the invention is described below while referring to FIG. 21. In FIG. 21, the same components as in the twelfth embodiment are identified with the same reference numerals, and a detailed description is omitted.

As shown in FIG. 21, a clutch output boss 74*d* is made of a part other than a dewatering shaft 37, and engaging clutches 37*a*, 74*j* for transmitting torque are provided in the dewatering shaft 37 and clutch output boss 74*d*. Due to the engagement to each other, the torque generated in the rotor 73*a* of the drive motor 73 is transmitted to the dewatering shaft 37.

In this constitution, the rotor 73*a* of the drive motor 73 and the clutch mechanism 74 can be assembled by being combined with the clutch spring 74*d* and first assembling and incorporating them into the dewatering shaft 37. Therefore, the assembling performance is enhanced, the clutch mechanism alone can be inspected, and only the clutch mechanism may be replaced.

A nineteenth embodiment of the invention is described below while referring to FIG. 22. The entire constitution of this washing machine is the same as in the first embodiment, and a detailed description is omitted.

Figure 22:
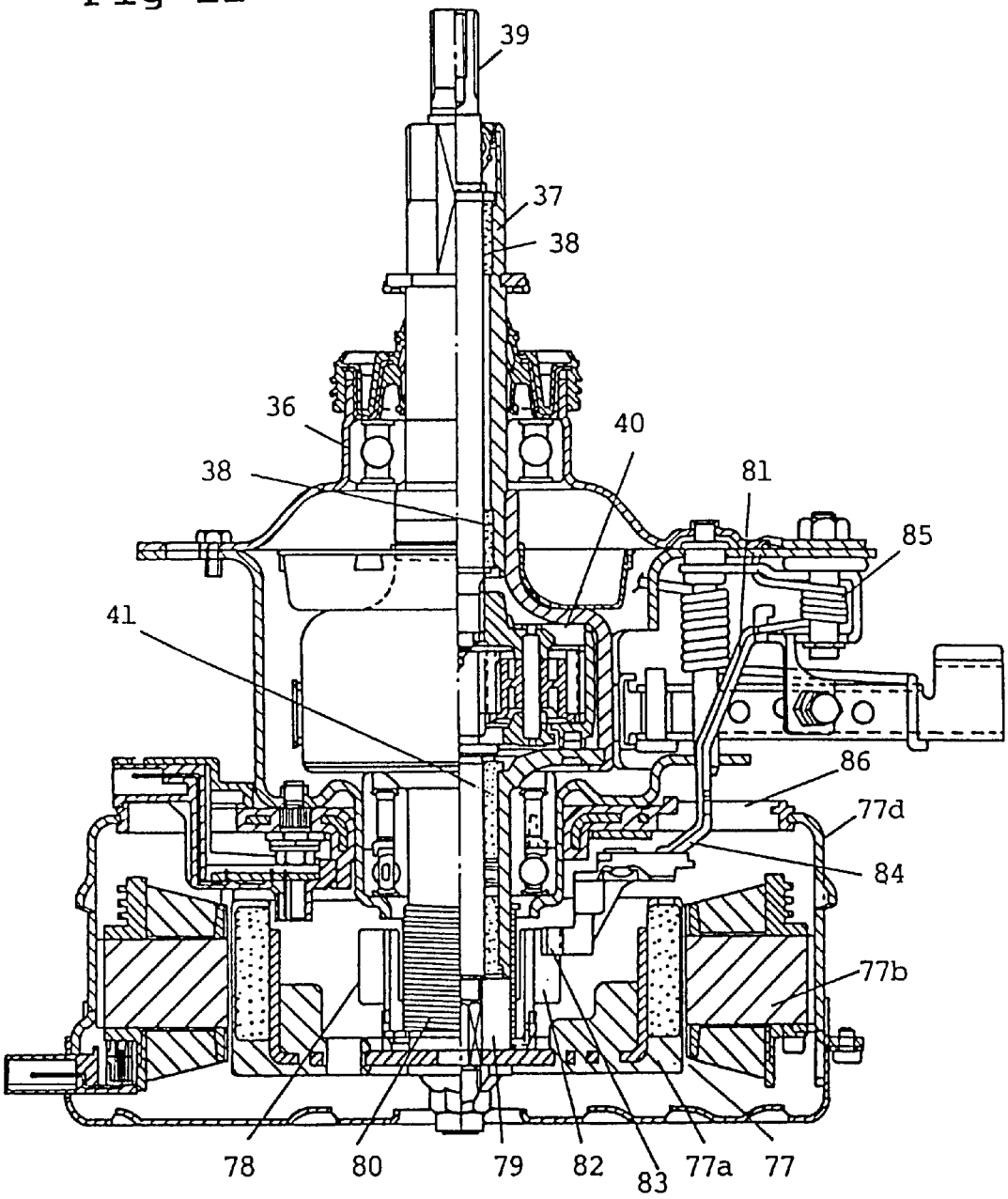
FIG. 22 is a sectional view showing a constitution of a drive unit of a washing machine in a nineteenth embodiment of the invention.

As shown in FIG. 22, a dewatering tank (not shown) is fixed at the upper end of a dewatering shaft 37 supported by a dewatering bearing 36 provided in the bottom of an outer tank (not shown). Agitating blades (not shown) are disposed in a hollow space of the dewatering shaft 37 so as to be coaxial with the dewatering shaft 37, and are fixed at the upper end of a washing shaft 39 supported by a washing bearing 38 provided in the hollow space of the dewatering shaft 37. The lower end of the washing shaft 39 is connected to the output side of a reduction mechanism 40.

A stator housing 77*d* for composing a drive motor 77 is attached to the reduction mechanism 40 with the cup-shaped opening downward, and a stator 77*b* for giving a rotary magnetic field to a rotor 77*a* is press-fitted in the stator housing 77*d*. The drive motor 77 is composed with the rotor 77*a* opposite to this stator 77*b*, the reduction mechanism 40 and drive motor 77 are coaxially disposed, and the drive motor 77 is mounted on the washing side input shaft 41 of the reduction mechanism 40.

A clutch mechanism 78 is provided for changing over the rotation of the drive motor 77 to either the dewatering shaft 37 or washing shaft 39. The clutch mechanism 78 is composed of a clutch box 79 having a fitting hole shape in the portion of cutting four sides provided in the washing side input shaft 41, a clutch spring 80, and a release sleeve 82 for transmitting the clutch changeover force of the clutch driving means 81 to the clutch spring 80, and is disposed in the space provided inside of the rotor 77*a*.

The clutch driving means 81 is provided for driving the clutch mechanism 78, and is composed of a clutch pawl 83, a clutch lever 84, a clutch changeover means (not shown) including a geared drive motor or the like for rotating the clutch lever 84, and a clutch lever spring 85.

A hole 86 is provided in the stator housing 77*d*. The clutch lever 84 of the clutch driving means 81 is inserted in this hole 86, and by driving the clutch driving means 81 from outside by the clutch changeover means, the clutch lever 84 is rotated. The other constitution is the same as in the first embodiment.

In this constitution, the operation is described below. In the washing and rinsing stroke, the clutch driving means 81 releases the clutch spring 80 of the clutch mechanism 78, so that torque is not transmitted to the dewatering shaft 37. The power of the drive motor 77 is transmitted only to the agitating blades through the washing shaft 39, and mechanical force is applied to the laundry. Thus, washing and rinsing of the laundry contained in the dewatering tank are progressed.

After the washing and rinsing stroke, the dewatering stroke begins automatically. In this dewatering stroke, the water in the dewatering tank is discharged, and the clutch spring 80 of the clutch mechanism 78 is driven so that torque can be transmitted to the dewatering shaft 37. By the power of the drive motor 77, the washing side input shaft 41 and dewatering shaft 37 are coupled, and the dewatering tank is rotated.

As the dewatering tank rotates, the water in the laundry after washing and rinsing is wrung out into the outer tank from multiple holes provided in the side of the dewatering tank by centrifugal force. Thus, the laundry is dewatered automatically. In this way, the laundry charged in the dewatering tank automatically finishes the strokes of washing, rinsing and dewatering.

Thus, according to the embodiment, the washing shaft 39 and dewatering shaft 37 are in a coaxial double structure, and from the side of the agitating blades, the reduction mechanism 40 and drive motor 77 are arranged sequentially. Since they are provided on the same axial line, the drive motor 77 and reduction mechanism 40 are integrated, and the center of gravity comes to the center of the outer tank, thereby eliminating the imbalance as experienced in the prior art when the drive motor 77 is not located in the center of the outer tank, and further suppressing vibration when dewatering. Moreover, since the reduction gear 40 and dewatering shaft 37 are directly rotated by the drive motor 77, the conventional belt is not necessary, and the number of parts can be curtailed.

Moreover, since the drive motor 77 is composed inside of the stator housing 77*d*, if water overflows from the outer tank due to some cause, water does not invade into the drive motor 77. Furthermore, if the area of the clutch lever 84 is touched by hand by mistake, the finger is not caught in the drive motor 77, so that the safety may be enhanced.

The stator housing 77*d* has a hole 86 for inserting the clutch lever 84 of the clutch driving means 81. Therefore, in a simple constitution, the clutch mechanism 78 of high reliability is composed, and the drive mechanism formed compact in the axial direction is obtained.

In this embodiment, the clutch mechanism 78 is composed of a clutch boss 79, a clutch spring 80, and a release sleeve 82. By driving the clutch drive means 81 from outside, rotation of the drive motor 77 is changed over to either the dewatering shaft 37 or the washing shaft 39. However, as in the first embodiment shown in FIG. 1, the clutch mechanism 46 may be composed of the torque transmitting unit for transmitting torque of the rotor 45*a* of the drive motor 45 and the drive unit for contacting with or departing from the torque transmitting unit, and the same action and effect are obtained.

A twentieth embodiment of the invention is described below while referring to FIG. 23.

Figure 23:
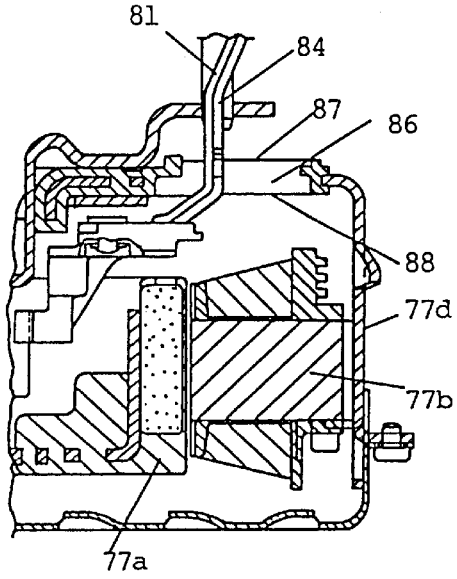
FIG. 23 is an essential sectional view showing a constitution of a drive unit of a washing machine in a twentieth embodiment of the invention.

As shown in FIG. 23, a stator housing 77*d* has a hole 86 for inserting and rotating a clutch lever 84 of clutch driving means 81. This hole 86 is formed so that the opening area is different between the inlet side 87 and outlet side 88 for inserting the clutch lever 84. The other constitution is the same as in the nineteenth embodiment.

Explaining the action in this constitution, the opening area of the hole 86 may be an area of minimum required limit, the strength of the stator housing 77*d* is enhanced, and the drive mechanism is formed shortly in the axial direction.

A twenty-first embodiment of the invention is described below while referring to FIG. 24.

Figure 24:
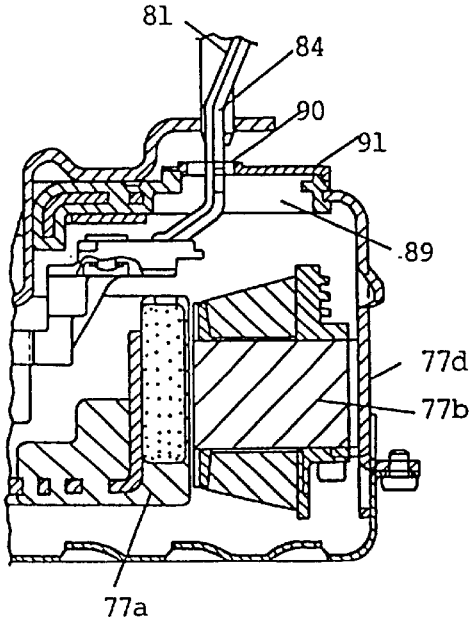
FIG. 24 is an essential sectional view showing a constitution of a drive unit of a washing machine in a twenty-first embodiment of the invention.

As shown in FIG. 24, a stator housing 77*d* has a hole 89 for inserting a clutch lever 84 of clutch driving means 81. This hole 89 has the size and shape necessary for inserting the clutch lever 84, and after inserting the clutch lever 84, it is coupled with a cover 91 having a hole 90 in a size and shape necessary for rotating the clutch lever 84. The other constitution is the same as in the nineteenth embodiment.

Explaining the action in this constitution, since the hole 89 provided in the stator housing 77*d* is coupled with the cover 91 having the hole 90 in a size and shape necessary for rotating the clutch lever 84, if water overflows from the outer tank due to some cause, the water falling on the floor hardly bounces to get into the stator housing 77*d* from the hole 90 in the cover 91. Alternatively, if the area of the clutch lever 84 is touched by hand by mistake, the finger is not caught in the stator housing 77*d*, so that the safety may be enhanced.

A twenty-second embodiment of the invention is described below while referring to FIG. 25.

Figure 25:
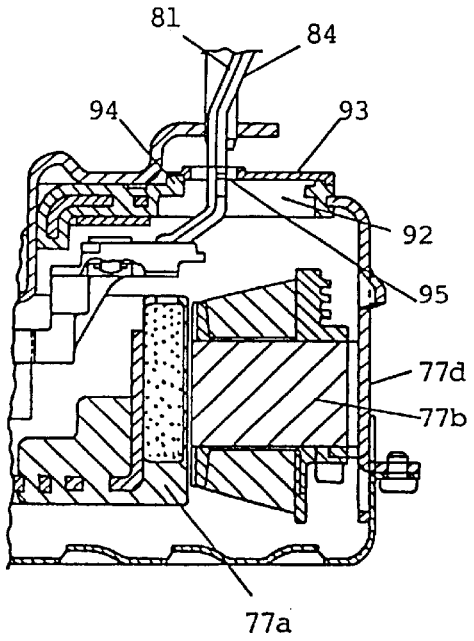
FIG. 25 is an essential sectional view showing a constitution of a drive unit of a washing machine in a twenty-second embodiment of the invention.

As shown in FIG. 25, a stator housing 77*d* has a hole 92 for inserting a clutch lever 84 of clutch driving means 81, and in part of the surrounding of this hole 92, there is a bump 94 to be fitted with a cover 93. The cover 93 has a hole 95 in a size and shape necessary for rotating the clutch lever 84. The other constitution is the same as in the twenty-first embodiment.

Explaining the action in this constitution, since the bump 94 to be fitted with the cover 93 is provided in part of the surrounding of the hole 92 provided in the stator housing 77*d,* if water overflows from the outer tank due to some cause, the water falling on the floor hardly bounces to get into the stator housing 77*d* from the hole 95 in the cover 93. Alternatively, if the area of the clutch lever 84 is touched by a hand by mistake, the finger is not caught in the stator housing 77*d,* so that the safety may be enhanced.

A twenty-third embodiment of the invention is described below while referring to FIG. 26.

Figure 26:
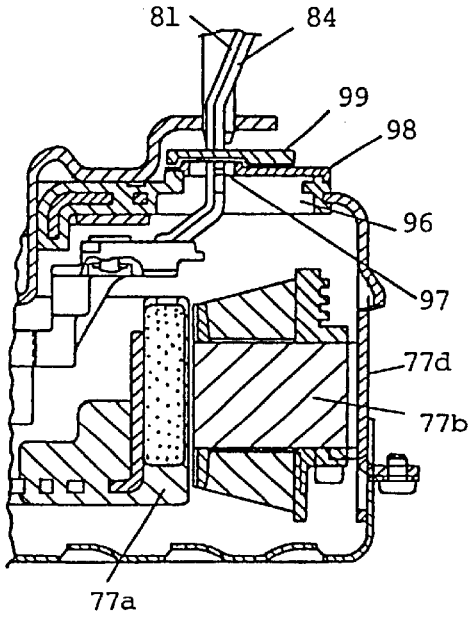
FIG. 26 is an essential sectional view showing a constitution of a drive unit of a washing machine in a twenty-third embodiment of the invention.

As shown in FIG. 26, a stator housing 77*d* has a hole 96 for inserting a clutch lever 84 of clutch driving means 81, and this hole 96 is provided with a cover 98 having a hole 97 in a size and shape necessary for rotating the clutch lever 84. A lid 99 is composed to cover a hole 97 opened in the cover 98, in cooperation with the clutch lever 84. Of course, if the clutch lever 84 rotates, the lid 99 is always covering the hole 97. The other constitution is the same as in the nineteenth embodiment.

Explaining the action in this constitution, since the hole 97 formed in the cover 98 is covered by the lid 99 cooperating with the clutch lever 84, if water overflows from the outer tank due to some cause, the water falling on the floor does not bounce to get into the stator housing 77*d* from the hole 97 in which the clutch lever 84 rotates. Alternatively, if the area of the clutch lever 84 is touched by a hand by mistake, the finger is not caught in the stator housing 77*d,* so that the safety may be enhanced.

A twenty-fourth embodiment of the invention is described below while referring to FIG. 27.

Figure 27:
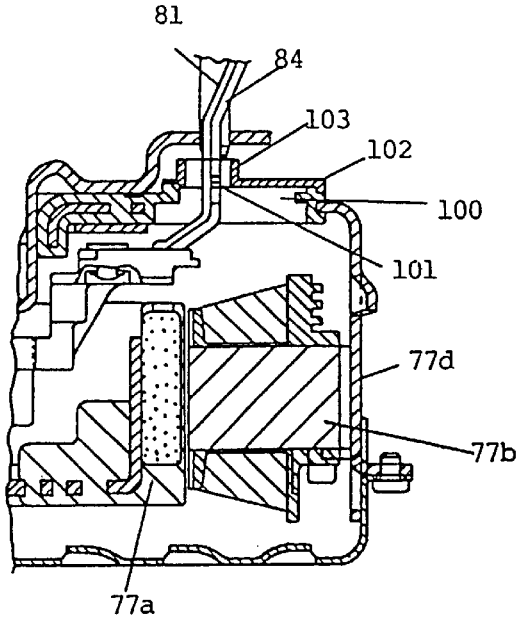
FIG. 27 is an essential sectional view showing a constitution of a drive unit of a washing machine in a twenty-fourth embodiment of the invention.

As shown in FIG. 27, a stator housing 77*d* has a hole 100 for inserting a clutch lever 84 of clutch driving means 81, and this hole 100 is provided with a cover 102 having a hole 101 in a size and shape necessary for rotating the clutch lever 84. A wall is provided in the hole 101 by a rib 103, and the position of the hole 101 is heightened. The other constitution is the same as in the nineteenth embodiment.

Explaining the action in this constitution, since the position of the hole 101 is heightened by forming the rib 103 as a wall in the hole 101 provided in the cover 102 in a size and shape necessary for rotating the clutch lever 84, if water overflows from the outer tank due to some cause, the water falling on the floor hardly bounces to get into the stator housing 77*d* from the hole 101 in which the clutch lever 84 rotates. Alternatively, if the area of the clutch lever 84 is touched by a hand by mistake, the finger is not caught in the stator housing 77*d,* so that the safety may be enhanced.

A twenty-fifth embodiment of the invention is described below while referring to FIG. 28.

Figure 28:
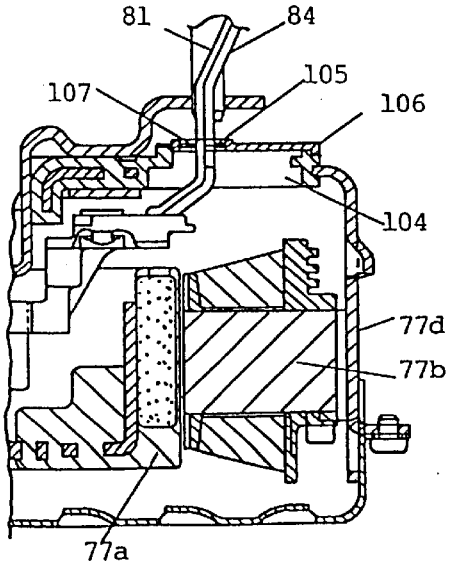
FIG. 28 is an essential sectional view showing a constitution of a drive unit of a washing machine in a twenty-fifth embodiment of the invention.

As shown in FIG. 28, a stator housing 77*d* has a hole 104 for inserting a clutch lever 84 of clutch driving means 81, and this hole 104 is provided with a cover 106 having a hole 105 in a size and shape necessary for rotating the clutch lever 84. The surrounding of the hole 105 is composed of a seal of a rubber-like elastic piece 107. The other constitution is the same as in the nineteenth embodiment.

Explaining the action in this constitution, since the surrounding of the hole 105 in a size and shape necessary for rotating the clutch lever 84 is composed of a seal of rubber-like elastic piece 107, if water overflows from the outer tank due to some cause, the water falling on the floor hardly bounces to get into the stator housing 77*d* from the hole 105 in which the clutch lever 84 rotates. Alternatively, if the area of the clutch lever 84 is touched by a hand by mistake, the finger is not caught in the stator housing 77*d,* so that the safety may be enhanced.

A twenty-sixth embodiment of the invention is described below while referring to FIG. 29.

Figure 29:
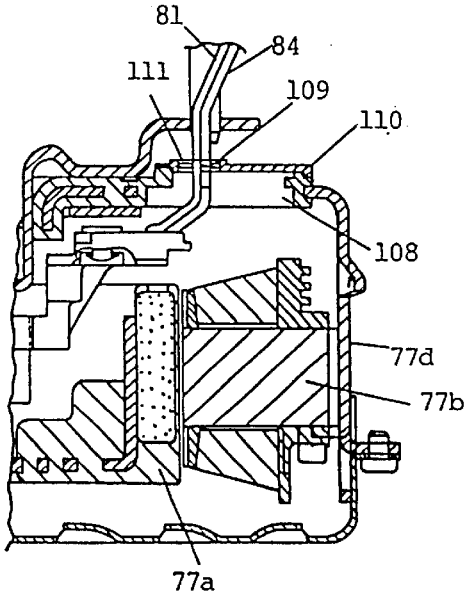
FIG. 29 is an essential sectional view showing a constitution of a drive unit of a washing machine in a twenty-sixth embodiment of the invention.

As shown in FIG. 29, a stator housing 77*d* has a hole 108 for inserting a clutch lever 84 of the clutch driving means 81, and this hole 108 is provided with a cover 110 having a hole 109 in a size and shape necessary for rotating the clutch lever 84. The surrounding of the hole 109 is composed of a brush-shaped seal 111. The other constitution is the same as in the nineteenth embodiment.

Explaining the action in this constitution, since the surrounding of the hole 109 in a size and shape necessary for rotating the clutch lever 84 is composed of the brushshaped seal 111, if water overflows from the outer tank due to some cause, the water falling on the floor hardly bounces to get into the stator housing 77*d* from the hole 109 in which the clutch lever 84 rotates. Alternatively, if the area of the clutch lever 84 is touched by a hand by mistake, the finger is not caught in the stator housing 77*d,* so that the safety may be enhanced.

A twenty-seventh embodiment of the invention is described below while referring to FIG. 30.

Figure 30:
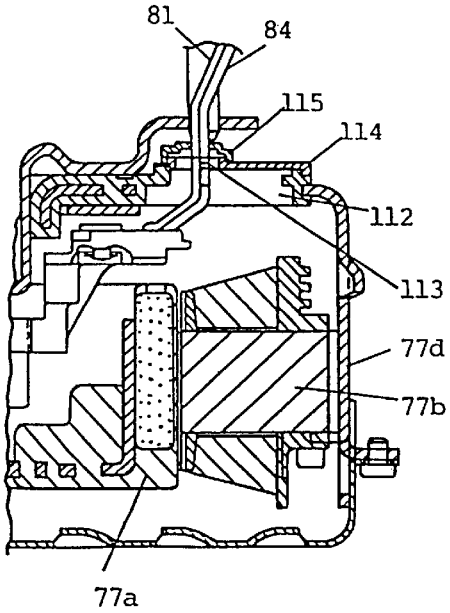
FIG. 30 is an essential sectional view showing a constitution of a drive unit of a washing machine in a twenty-seventh embodiment of the invention.
Figure 31:
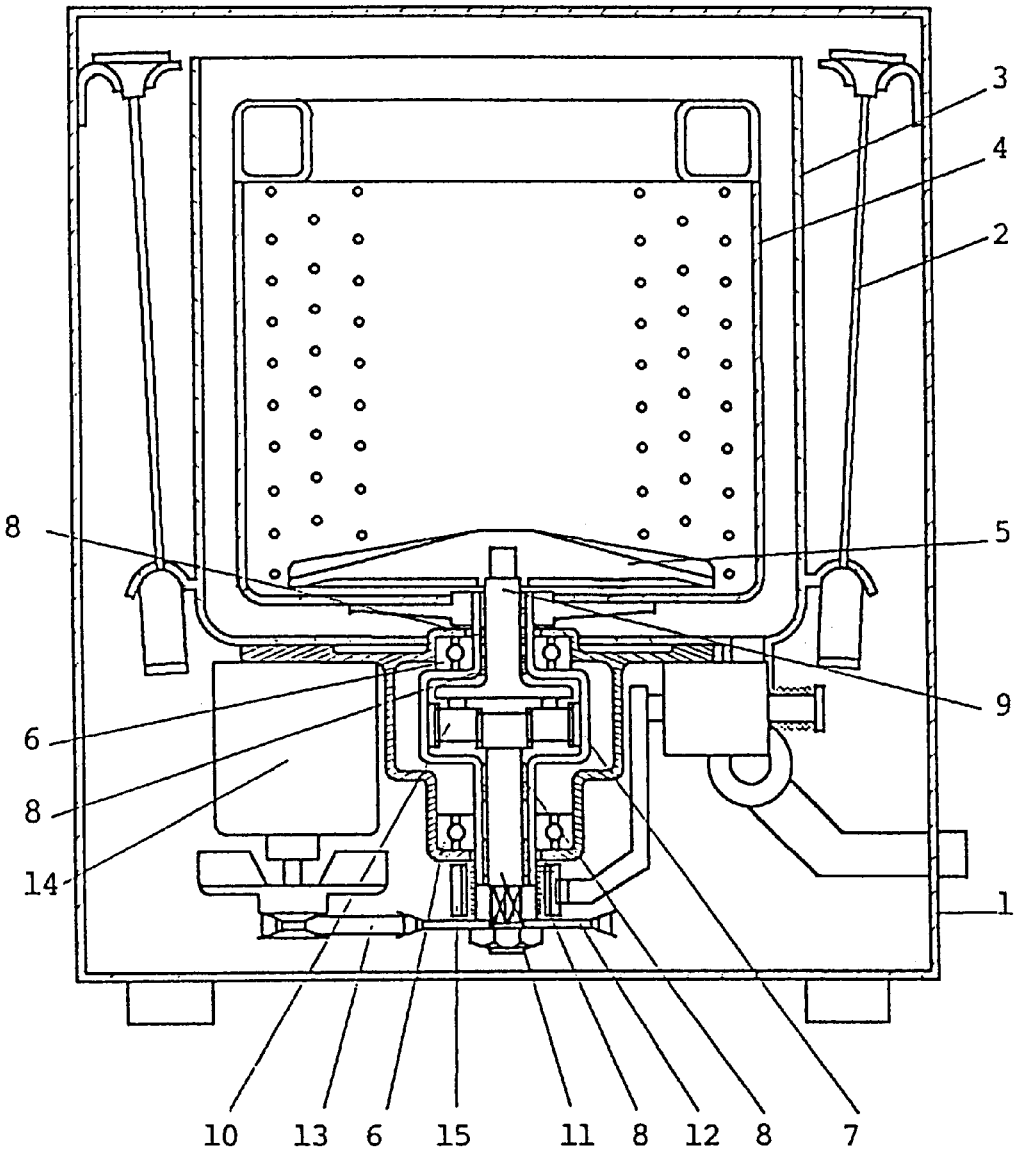
Fig 31 PRIOR ART
FIG. 31 is a sectional view of a conventional washing machine.
Figure 32:
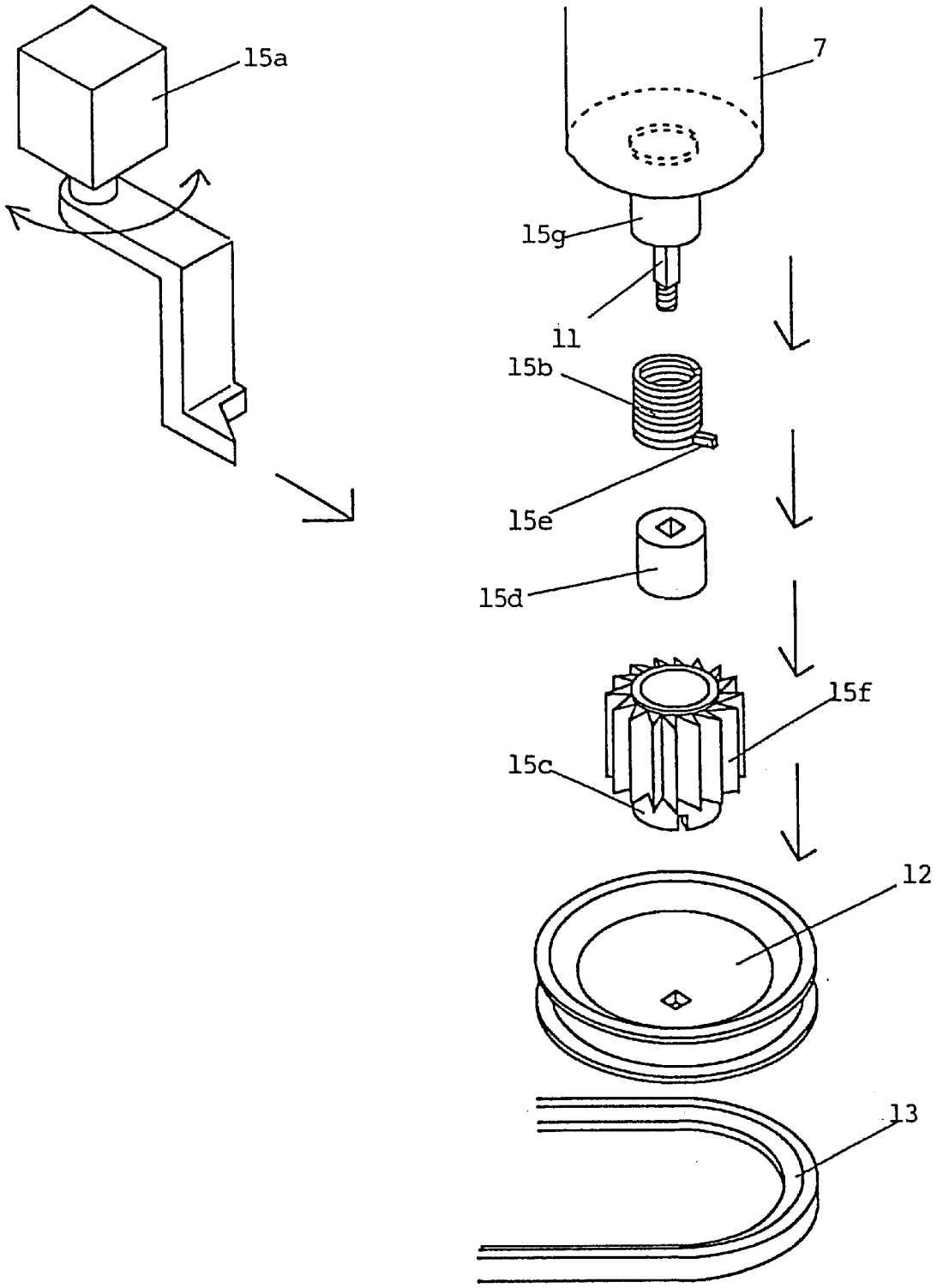
Fig 32 PRIOR ART
FIG. 32 is a perspective exploded view showing a constitution of a drive unit of the same conventional washing machine.
Figure 33:
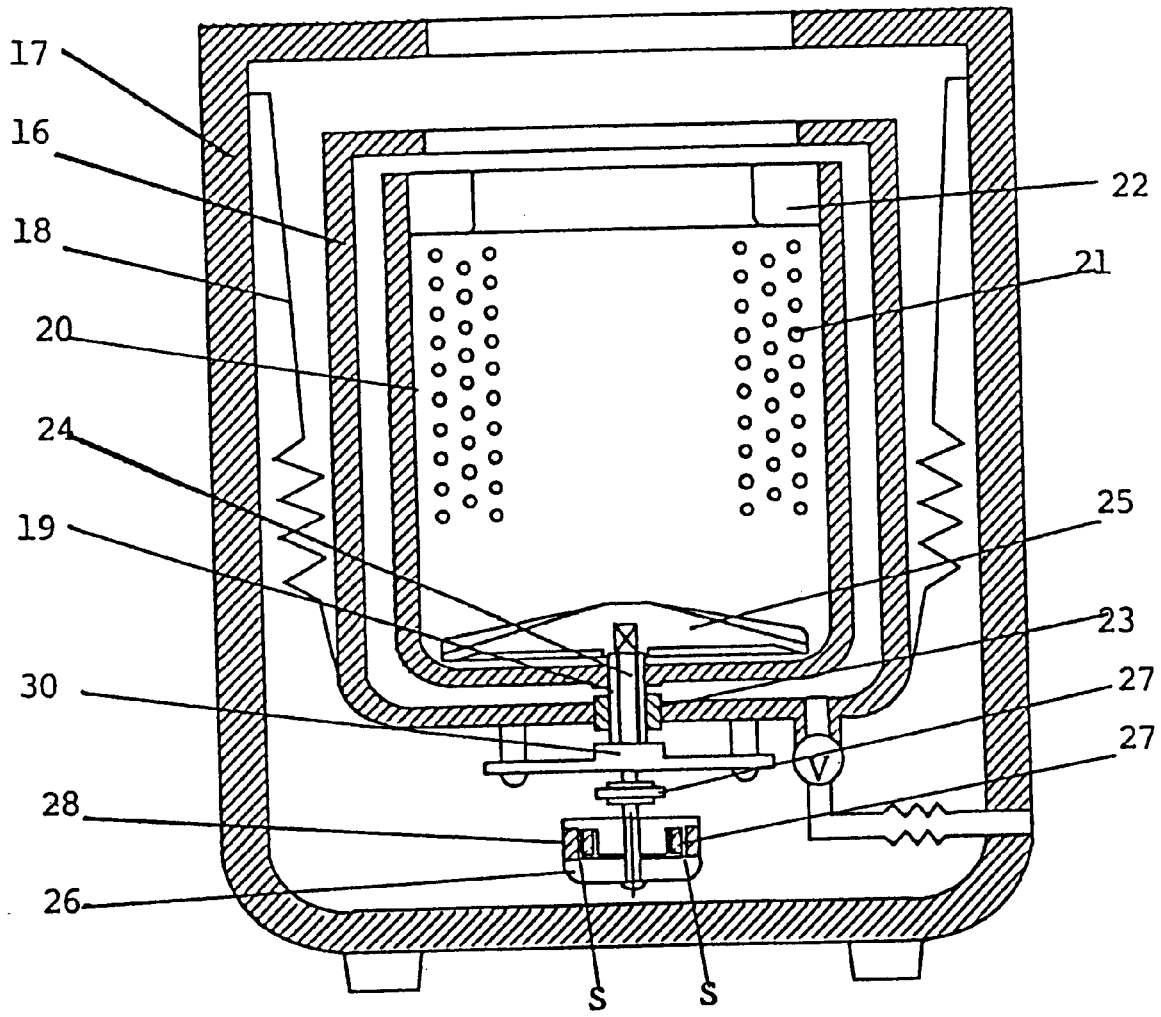
Fig 33 PRIOR ART
FIG. 33 is a sectional view of another conventional washing machine.

As shown in FIG. 30, a stator housing 77*d* has a hole 112 for inserting a clutch lever 84 of clutch driving means 81, and this hole 112 is provided with a cover 114 having a hole 113 in a size and shape necessary for rotating the clutch lever 84. The surrounding of the hole 113 is composed of a flexible tube 115 made of bellows-like elastic piece cooperating with the clutch lever 84. The other constitution is the same as in the nineteenth embodiment.

Explaining the action in this constitution, since the surrounding of the hole 113 in a size and shape necessary for rotating the clutch lever 84 is composed of the flexible tube 115 made of bellows-like elastic piece cooperating with the clutch lever 84, if water overflows from the outer tank due to some cause, the water falling on the floor hardly bounces to get into the stator housing 77*d* from the hole 113 in which the clutch lever 84 rotates. Alternatively, if the area of the clutch lever 84 is touched by a hand by mistake, the finger is not caught in the stator housing 77*d,* so that the safety may be enhanced.

What is claimed is:

1. A washing machine comprising:

a hollow dewatering shaft for rotating a dewatering tank;

a washing shaft disposed coaxially with said dewatering shaft for rotating agitating blades disposed in said dewatering tank;

a drive motor having a rotor and an axis of rotation and being adapted to rotate said dewatering shaft and said washing shaft;

a reduction mechanism having an axis of rotation and being adapted to decelerate the rotation of said drive motor and to rotate said washing shaft; and a clutch mechanism for transmitting or not transmitting the rotation of the drive motor to the dewatering shaft;

wherein said reduction mechanism and said drive motor are disposed coaxially, said clutch mechanism including a torque transmitting unit for transmitting the rotation of said drive motor to said dewatering shaft, and including a drive unit for contacting with or departing from said torque transmitting unit, a portion of said torque transmitting unit being formed in said rotor of said drive motor.

2. A washing machine of claim 1, wherein said portion comprises a first portion, a second portion of said torque transmitting unit of said clutch mechanism being formed at an outer circumferential side of said rotor.

3. A washing machine of claim 1, wherein said torque transmitting unit includes a fixed clutch formed in said rotor, and a movable clutch to contact with or depart from said fixed clutch based on a movement of said drive unit of said clutch mechanism, said movable clutch being operable to contact said fixed clutch when dewatering and to depart from said fixed clutch when washing based on an action of said drive unit of said clutch mechanism.

4. A washing machine of claim 3, further comprising a case for accommodating said reduction mechanism and a stopping part provided in a lower part of said case, an engaging part to be engaged with said stopping part of said case being provided in said movable clutch, wherein during washing, said engaging part of said movable clutch is stopped by said stopping part of said case so as to block rotation of said movable clutch.

5. A washing machine of claim 1, wherein said rotor includes a disk and a magnet mounting part extending in a height direction on an outer circumference of said disk, said torque transmitting unit of said clutch mechanism being disposed in a space enclosed by said disk and said magnet mounting part.

6. A washing machine of claim 5, wherein said reduction mechanism is enclosed by said drive motor.

7. A washing machine of claim 1, wherein said reduction mechanism is enclosed by said drive motor.

* * * * *